US010167760B2

(12) United States Patent
Yamaguchi et al.

(10) Patent No.: US 10,167,760 B2
(45) Date of Patent: Jan. 1, 2019

(54) CONTROL SYSTEM OF INTERNAL COMBUSTION ENGINE

(71) Applicant: TOYOTA JIDOSHA KABUSHIKI KAISHA, Toyota-shi, Aichi (JP)

(72) Inventors: Yuji Yamaguchi, Susono (JP); Norihisa Nakagawa, Susono (JP); Shuntaro Okazaki, Shizuoka (JP); Yuji Miyoshi, Susono (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 56 days.

(21) Appl. No.: 15/110,427

(22) PCT Filed: Dec. 18, 2014

(86) PCT No.: PCT/JP2014/084444
§ 371 (c)(1),
(2) Date: Jul. 8, 2016

(87) PCT Pub. No.: WO2015/105013
PCT Pub. Date: Jul. 16, 2015

(65) Prior Publication Data

US 2016/0341088 A1 Nov. 24, 2016

(30) Foreign Application Priority Data

Jan. 10, 2014 (JP) ..... 2014-003286

(51) Int. Cl.
*F01N 3/20* (2006.01)
*F02D 41/14* (2006.01)
(Continued)

(52) U.S. Cl.
CPC ..... *F01N 3/20* (2013.01); *F02D 35/0015* (2013.01); *F02D 41/0295* (2013.01);
(Continued)

(58) Field of Classification Search
CPC .... F01N 3/20; F01N 2570/14; F02D 35/0015; F02D 41/0295; F02D 41/1475;
(Continued)

(56) References Cited

U.S. PATENT DOCUMENTS 5,758,490 A 6/1998 Maki et al.
5,894,725 A * 4/1999 Cullen ..... F01N 13/009 60/274
(Continued)

FOREIGN PATENT DOCUMENTS

CN 1886585 A 12/2006
DE 10 2004 019 660 A1 1/2005
(Continued)

*Primary Examiner* — Phutthiwat Wongwian
*Assistant Examiner* — Matthew T Largi
(74) *Attorney, Agent, or Firm* — Hunton Andrews Kurth LLP

(57) ABSTRACT

An internal combustion engine comprises an exhaust purification catalyst. The control system comprises a temperature detecting means for detecting or estimating a temperature of the exhaust purification catalyst, performs feedback control so that an air-fuel ratio of exhaust gas flowing into the exhaust purification catalyst becomes a target air-fuel ratio, and performs target air-fuel ratio setting control which alternately sets the target air-fuel ratio to a rich set air-fuel ratio and a lean set air-fuel ratio. In addition, the control system increases a variation difference, obtained by subtracting a rich degree of the rich set air-fuel ratio from a lean degree of a lean set air-fuel ratio, when a temperature of the exhaust purification catalyst detected or estimated by the temperature detecting means is a predetermined upper limit temperature or less compared with when it is higher than the upper limit temperature. As a result, a sulfur ingredient storage amount of an exhaust purification catalyst is maintained low.

12 Claims, 15 Drawing Sheets

(51) Int. Cl.
*F02D 35/00* (2006.01)
*F02D 41/02* (2006.01)

(52) U.S. Cl.
CPC ..... *F02D 41/1475* (2013.01); *F01N 2570/14* (2013.01); *F02D 41/025* (2013.01); *F02D 2200/0802* (2013.01); *F02D 2200/0816* (2013.01)

(58) Field of Classification Search
CPC ..... F02D 2200/0802; F02D 2200/0816; F02D 41/025
See application file for complete search history.

(56) References Cited

U.S. PATENT DOCUMENTS 5,948,974 A * 9/1999 Mitsutani ..... F01N 11/005 60/276
5,953,907 A * 9/1999 Kato ..... B01D 53/9431 60/274
2007/0125347 A1* 6/2007 Nakagawa ..... F01N 3/101 123/672
2009/0320454 A1* 12/2009 Sawada ..... F01N 3/0864 60/285
2010/0146936 A1* 6/2010 Sawada ..... F01N 11/00 60/277
2016/0061084 A1 3/2016 Okazaki et al.

FOREIGN PATENT DOCUMENTS

| | | | |
|---|---|---|---|
| EP | 0 878 611 | A2 | 11/1998 |
| JP | S62-126234 | A | 6/1987 |
| JP | H06-307271 | A | 11/1994 |
| JP | H08-232723 | A | 9/1996 |
| JP | H10-311213 | A | 11/1998 |
| JP | 2004-324455 | A | 11/2004 |
| JP | 2005-163614 | A | 6/2005 |
| JP | 2006-183636 | A | 7/2006 |
| WO | 2005/054651 | A1 | 6/2005 |
| WO | 2014/118892 | A1 | 8/2014 |

* cited by examiner

CONTROL SYSTEM OF INTERNAL COMBUSTION ENGINE

CROSS-REFERENCE TO RELATED APPLICATIONS

This is a national phase application based on the PCT International Patent Application No. PCT/JP2014/084444 filed Dec. 18, 2014, claiming priority to Japanese Patent Application No. 2014-003286 filed Jan. 10, 2014, the entire contents of both of which are incorporated herein by reference.

TECHNICAL FIELD

The present invention relates to a control system of an internal combustion engine.

BACKGROUND ART

In the past, a control system of an internal combustion engine which is provided with an air-fuel ratio sensor in an exhaust passage of the internal combustion engine and controls the amount of fuel supplied to the internal combustion engine based on the output of this air-fuel ratio sensor, has been widely known. In particular, as such a control system, one which is provided with an air-fuel ratio sensor at an upstream side of an exhaust purification catalyst provided in the engine exhaust passage and which is provided with an oxygen sensor at a downstream side thereof, is known (for example, PLT's 1 to 4).

In particular, in the control system described in PLT 1, the amount of fuel fed to the internal combustion engine is controlled in accordance with the air-fuel ratio detected by the upstream side air-fuel ratio sensor so that this air-fuel ratio becomes a target air-fuel ratio. In addition, the target air-fuel ratio is corrected in accordance with the oxygen concentration detected by the downstream side oxygen sensor. According to PLT 1, due to this, even if the upstream side air-fuel ratio sensor deteriorates due to age or there are individual variability, the air-fuel ratio of the exhaust gas flowing into the exhaust purification catalyst can match with the target value.

CITATIONS LIST

Patent Literature

PLT 1: Japanese Patent Publication No. 8-232723A
PLT 2: Japanese Patent Publication No. 2005-163614A
PLT 3: Japanese Patent Publication No. 2006-183636A
PLT 4: Japanese Patent Publication No. 6-307271A
PLT 5: Japanese Patent Publication No. 62-126234A

SUMMARY OF INVENTION

Technical Problem

In this regard, according to the inventors of this application, a control system performing control different from the control system described in the above-mentioned PLT 1, has been proposed. In this control system, when the air-fuel ratio detected by the downstream side air-fuel ratio sensor becomes a rich judgment air-fuel ratio (air-fuel ratio slightly richer than stoichiometric air-fuel ratio) or less, the target air-fuel ratio is set to an air-fuel ratio leaner than the stoichiometric air-fuel ratio (below, referred to as a "lean air-fuel ratio"). On the other hand, when, while the target air-fuel ratio is set to the lean air-fuel ratio, the amount of oxygen storage of the exhaust purification catalyst becomes not smaller than a switching reference storage amount which is smaller than the maximum storable oxygen amount, the target air-fuel ratio is set to an air-fuel ratio richer than the stoichiometric air-fuel ratio (below, referred to as a "rich air-fuel ratio"). That is, in this control system, the target air-fuel ratio is alternately switched between the rich air-fuel ratio and the lean air-fuel ratio.

When performing control in this way for alternately switching the target air-fuel ratio between the rich air-fuel ratio and the lean air-fuel ratio, the exhaust purification catalyst stores and releases oxygen. If the oxygen storage amount of the exhaust purification catalyst reaches the maximum storable oxygen amount, the exhaust purification catalyst can no longer store more oxygen. For this reason, oxygen and $NO_X$ flow out from the exhaust purification catalyst. Therefore, to suppress the outflow of $NO_X$ from the exhaust purification catalyst, the maximum storable oxygen amount of the exhaust purification catalyst must be maintained large.

In this regard, exhaust gas discharged from an engine body contains sulfur ingredients including $SO_X$. If the exhaust purification catalyst stores these sulfur ingredients, the maximum storable oxygen amount of the exhaust purification catalyst is reduced by that amount. Therefore, from the viewpoint of maintaining the maximum storable oxygen amount of the exhaust purification catalyst high, the amount of storage of the sulfur ingredients of the exhaust purification catalyst must be kept low.

Therefore, in view of this problem, an object of the present invention is to provide a control system of an internal combustion engine which performs control to alternately switch a target air-fuel ratio between a rich air-fuel ratio and a lean air-fuel ratio wherein the amount of storage of the sulfur ingredients of the exhaust purification catalyst is kept low.

Solution to Problem

To solve this problem, in a first aspect of the invention, there is provided a control system of an internal combustion engine, the internal combustion engine comprising an exhaust purification catalyst which is arranged in an exhaust passage of the internal combustion engine and which can store oxygen, the control system of an internal combustion engine comprising a temperature detecting means for detecting or estimating a temperature of the exhaust purification catalyst, performing feedback control so that an air-fuel ratio of exhaust gas flowing into the exhaust purification catalyst becomes a target air-fuel ratio, and performing target air-fuel ratio setting control which alternately sets the target air-fuel ratio to a rich set air-fuel ratio richer than a stoichiometric air-fuel ratio and a lean set air-fuel ratio leaner than the stoichiometric air-fuel ratio, wherein when the temperature of the exhaust purification catalyst which has been detected or estimated by the temperature detecting means is a predetermined upper limit temperature or less, compared to when it is higher than the upper limit temperature, a variation difference, obtained by subtracting a rich degree which is a difference of the rich set air-fuel ratio and stoichiometric air-fuel ratio from a lean degree which is a difference of the lean set air-fuel ratio and stoichiometric air-fuel ratio, is increased.

In a second aspect of the invention, there is provided the first aspect of the invention, wherein when the temperature of the exhaust purification catalyst which has been detected or estimated by the temperature detecting means is the predetermined upper limit temperature or less, compared to when it is higher than the upper limit temperature, a lean degree of the lean set air-fuel ratio is set larger.

In a third aspect of the invention, there is provided the first or second aspect of the invention, wherein when the temperature of the exhaust purification catalyst which has been detected or estimated by the temperature detecting means is the predetermined upper limit temperature or less, compared to when it is higher than the upper limit temperature, a rich degree of the rich set air-fuel ratio is set smaller.

In a fourth aspect of the invention, there is provided any one of the first to third aspects of the invention, wherein the temperature detecting means is an intake air amount detecting means for detecting or estimating an intake air amount of the internal combustion engine and, when an intake air amount detected or estimated by the intake air amount detecting means is a predetermined upper limit intake air amount or less, it is estimated that the temperature of the exhaust purification catalyst is the upper limit temperature or less.

In a fifth aspect of the invention, there is provided any one of the first to third aspects of the invention, wherein the temperature detecting means estimates that the temperature of the exhaust purification catalyst is the upper limit temperature or less when the internal combustion engine is engaged in idling operation.

In a sixth aspect of the invention, there is provided any one of the first to fifth aspect of the invention, further comprising a downstream side air-fuel ratio sensor which is arranged at a downstream side of a direction of flow of exhaust of the exhaust purification catalyst and which detects an air-fuel ratio of the exhaust gas flowing out from the exhaust purification catalyst, wherein in the target air-fuel ratio setting control, when the air-fuel ratio detected by the downstream side air-fuel ratio sensor becomes not higher than a rich judgment air-fuel ratio richer than the stoichiometric air-fuel ratio or less, the target air-fuel ratio is switched to the lean set air-fuel ratio, and when an oxygen storage amount of the exhaust purification catalyst becomes not smaller than a predetermined the switching reference storage amount which is smaller than the maximum storable oxygen amount, the target air-fuel ratio is switched to the rich set air-fuel ratio.

In a seventh aspect of the invention, there is provided any one of the first to fifth aspects of the invention, further comprising a downstream side air-fuel ratio sensor which is arranged at a downstream side of a direction of flow of exhaust of the exhaust purification catalyst and which detects an air-fuel ratio of the exhaust gas flowing out from the exhaust purification catalyst, wherein in the target air-fuel ratio setting control, when the air-fuel ratio detected by the downstream side air-fuel ratio sensor becomes not higher than a rich judgment air-fuel ratio richer than the stoichiometric air-fuel ratio, the target air-fuel ratio is switched to the lean set air-fuel ratio, and when the air-fuel ratio detected by the downstream side air-fuel ratio sensor becomes not lower than a lean judgment air-fuel ratio leaner than the stoichiometric air-fuel ratio, the target air-fuel ratio is switched to the rich set air-fuel ratio.

Advantageous Effects of Invention

According to the present invention, the amount of storage of the sulfur ingredients of the exhaust purification catalyst can be kept low.

DESCRIPTION OF EMBODIMENTS

Figure 1:
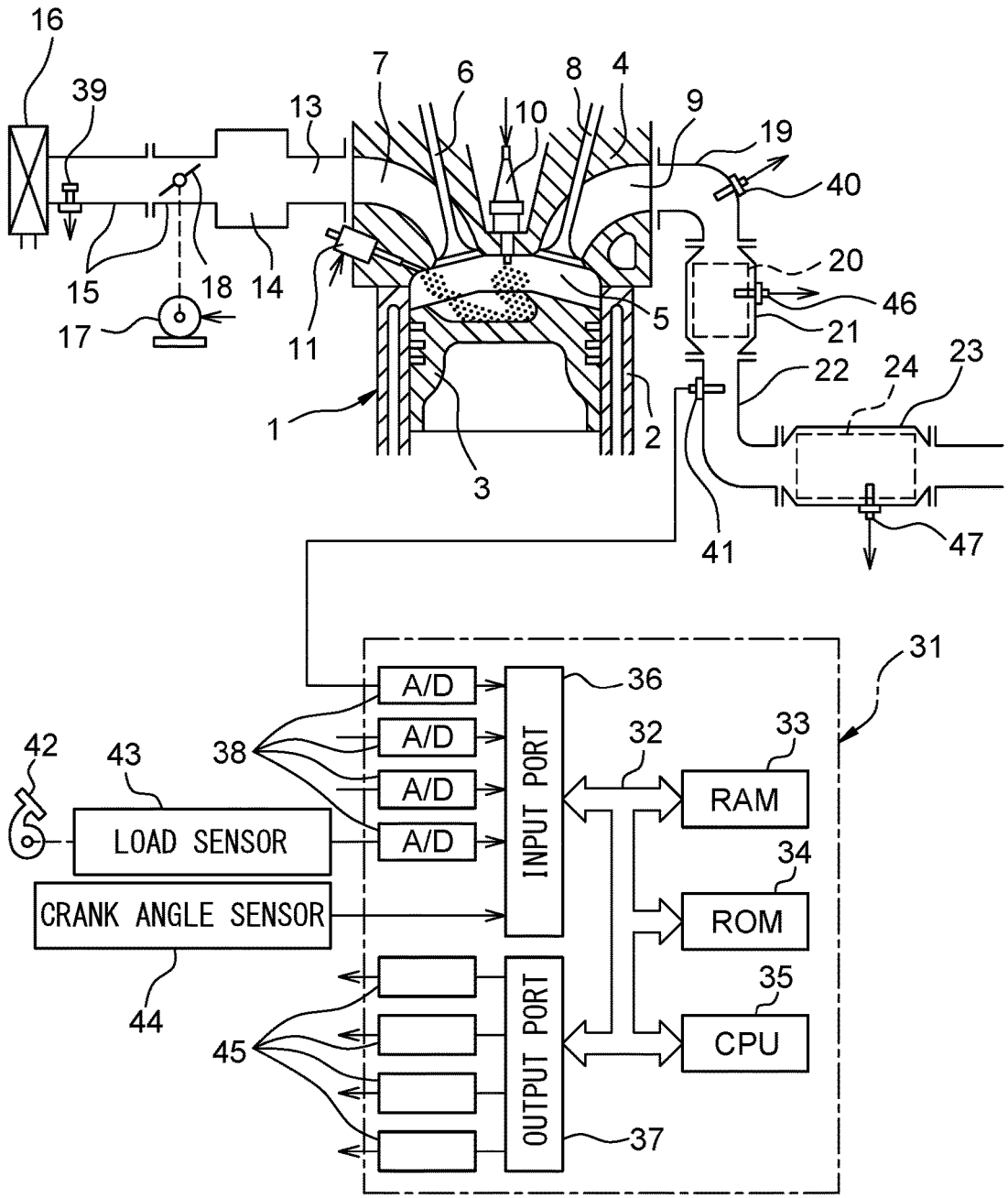
FIG. 1 is a view which schematically shows an internal combustion engine in which a control device of the present invention is used.

Below, referring to the drawings, embodiments of the present invention will be explained in detail. Note that, in the following explanation, similar component elements are assigned the same reference numerals.

<Explanation of Internal Combustion Engine as a Whole>

FIG. 1 is a view which schematically shows an internal combustion engine in which a control system according to the present invention is used. In FIG. 1, 1 indicates an engine body, 2 a cylinder block, 3 a piston which reciprocates in the cylinder block 2, 4 a cylinder head which is fastened to the cylinder block 2, 5 a combustion chamber which is formed between the piston 3 and the cylinder head 4, 6 an intake valve, 7 an intake port, 8 an exhaust valve, and 9 an exhaust port. The intake valve 6 opens and closes the intake port 7, while the exhaust valve 8 opens and closes the exhaust port 9.

As shown in FIG. 1, a spark plug 10 is arranged at a center part of an inside wall surface of the cylinder head 4, while a fuel injector 11 is arranged at a peripheral part of the inner wall surface of the cylinder head 4. The spark plug 10 is configured to generate a spark in accordance with an ignition signal. Further, the fuel injector 11 injects a predetermined amount of fuel into the combustion chamber 5 in accordance with an injection signal. Note that, the fuel injector 11 may also be arranged so as to inject fuel into the intake port 7. Further, in the present embodiment, as the fuel, gasoline with a stoichiometric air-fuel ratio of 14.6 is used. However, the internal combustion engine of the present embodiment may also use another fuel.

The intake port 7 of each cylinder is connected to a surge tank 14 through a corresponding intake runner 13, while the surge tank 14 is connected to an air cleaner 16 through an intake pipe 15. The intake port 7, intake runner 13, surge tank 14, and intake pipe 15 form an intake passage. Further, inside the intake pipe 15, a throttle valve 18 which is driven by a throttle valve drive actuator 17 is arranged. The throttle valve 18 can be operated by the throttle valve drive actuator 17 to thereby change the aperture area of the intake passage.

On the other hand, the exhaust port 9 of each cylinder is connected to an exhaust manifold 19. The exhaust manifold 19 has a plurality of runners which are connected to the exhaust ports 9 and a collected part at which these runners are collected. The collected part of the exhaust manifold 19 is connected to an upstream side casing 21 which houses an upstream side exhaust purification catalyst 20. The upstream side casing 21 is connected through an exhaust pipe 22 to a downstream side casing 23 which houses a downstream side exhaust purification catalyst 24. The exhaust port 9, exhaust manifold 19, upstream side casing 21, exhaust pipe 22, and downstream side casing 23 form an exhaust passage.

The electronic control unit (ECU) 31 consists of a digital computer which is provided with components which are connected together through a bidirectional bus 32 such as a RAM (random access memory) 33, ROM (read only memory) 34, CPU (microprocessor) 35, input port 36, and output port 37. In the intake pipe 15, an airflow meter 39 is arranged for detecting the flow rate of air flowing through the intake pipe 15. The output of this airflow meter 39 is input through a corresponding AD converter 38 to the input port 36. Further, at the collected part of the exhaust manifold 19, an upstream side air-fuel ratio sensor 40 is arranged which detects the air-fuel ratio of the exhaust gas flowing through the inside of the exhaust manifold 19 (that is, the exhaust gas flowing into the upstream side exhaust purification catalyst 20). In addition, in the exhaust pipe 22, a downstream side air-fuel ratio sensor 41 is arranged which detects the air-fuel ratio of the exhaust gas flowing through the inside of the exhaust pipe 22 (that is, the exhaust gas flowing out from the upstream side exhaust purification catalyst 20 and flowing into the downstream side exhaust purification catalyst 24). The outputs of these air-fuel ratio sensors 40 and 41 are also input through the corresponding AD converters 38 to the input port 36. Further, the upstream side exhaust purification catalyst 20 is provided with an upstream side temperature sensor 46 for detecting a temperature of the upstream side exhaust purification catalyst 20, and the downstream side exhaust purification catalyst 24 is provided with a downstream side temperature sensor 47 for detecting the temperature of the downstream side exhaust purification catalyst 24. The outputs of these temperature sensors 46 and 47 are also input through the corresponding AD converters 38 to the input port 36.

Further, an accelerator pedal 42 is connected to a load sensor 43 generating an output voltage which is proportional to the amount of depression of the accelerator pedal 42. The output voltage of the load sensor 43 is input to the input port 36 through a corresponding AD converter 38. The crank angle sensor 44 generates an output pulse every time, for example, a crankshaft rotates by 15 degrees. This output pulse is input to the input port 36. The CPU 35 calculates the engine speed from the output pulse of this crank angle sensor 44. On the other hand, the output port 37 is connected through corresponding drive circuits 45 to the spark plugs 10, fuel injectors 11, and throttle valve drive actuator 17. Note that, the ECU 31 functions as a control system for controlling the internal combustion engine.

Note that, the internal combustion engine according to the present embodiment is a non-supercharged internal combustion engine which is fueled by gasoline, but the internal combustion engine according to the present invention is not limited to the above configuration. For example, the internal combustion engine according to the present invention may have way of fuel injection, configuration of intake and exhaust systems, configuration of valve mechanism, presence of supercharger, and/or supercharging way, etc. which are different from the above internal combustion engine.

<Explanation of Exhaust Purification Catalyst>

The upstream side exhaust purification catalyst 20 and downstream side exhaust purification catalyst 24 have similar configurations. The exhaust purification catalysts 20 and 24 are three-way catalysts having oxygen storage abilities. Specifically, the exhaust purification catalysts 20 and 24 are formed such that on substrate consisting of ceramic, a precious metal having a catalytic action (for example, platinum (Pt)) and a substance having an oxygen storage ability (for example, ceria ($CeO_2$)) are carried. The exhaust purification catalysts 20 and 24 exhibit a catalytic action of simultaneously removing unburned gas (HC, CO, etc.) and nitrogen oxides ($NO_X$) and, in addition, an oxygen storage ability, when reaching a predetermined activation temperature.

According to the oxygen storage ability of the exhaust purification catalysts 20 and 24, the exhaust purification catalysts 20 and 24 store the oxygen in the exhaust gas when the air-fuel ratio of the exhaust gas flowing into the exhaust purification catalysts 20 and 24 is leaner than the stoichiometric air-fuel ratio (lean air-fuel ratio). On the other hand, the exhaust purification catalysts 20 and 24 release the oxygen stored in the exhaust purification catalysts 20 and 24 when the air-fuel ratio of the inflowing exhaust gas is richer than the stoichiometric air-fuel ratio (rich air-fuel ratio).

Figure 2A:
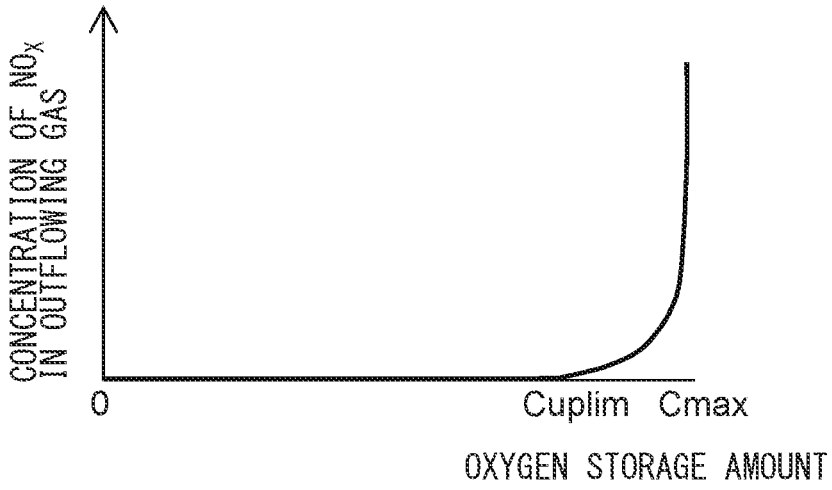
FIG. 2 is a view which shows the relationship between the stored amount of oxygen of the exhaust purification catalyst and concentration of $NO_X$ or concentration of HC or CO in the exhaust gas flowing out from the exhaust purification catalyst.
Figure 2B:
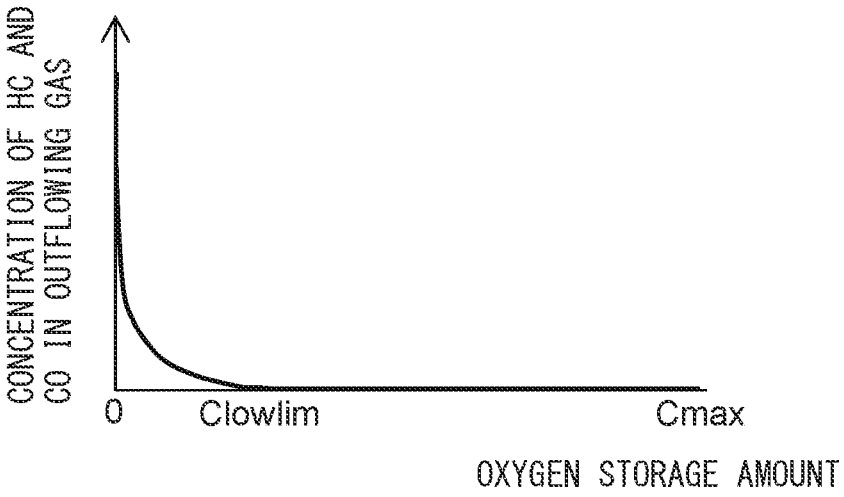

The exhaust purification catalysts 20 and 24 have a catalytic action and oxygen storage ability and thereby have the action of purifying $NO_X$ and unburned gas according to the stored amount of oxygen. That is, as shown on solid line in FIG. 2A, in the case where the air-fuel ratio of the exhaust gas flowing into the exhaust purification catalysts 20 and 24 is a lean air-fuel ratio, when the stored amount of oxygen is small, the exhaust purification catalysts 20 and 24 store the oxygen in the exhaust gas. Further, along with this, the $NO_X$ in the exhaust gas is reduced and purified. On the other hand, if the stored amount of oxygen becomes larger beyond a certain stored amount near the maximum storable oxygen amount Cmax (in the figure, Cuplim), the exhaust gas flowing out from the exhaust purification catalysts 20 and 24 rises in concentration of oxygen and $NO_X$ On the other hand, as shown on solid line in FIG. 2B, in the case where the air-fuel ratio of the exhaust gas flowing into the exhaust purification catalysts 20 and 24 is the rich air-fuel ratio, when the stored amount of oxygen is large, the oxygen stored in the exhaust purification catalysts 20 and 24 is released, and the unburned gas in the exhaust gas is oxidized and purified. On the other hand, if the stored amount of oxygen becomes small, the exhaust gas flowing out from the exhaust purification catalysts 20 and 24 rapidly rises in concentration of unburned gas at a certain stored amount near zero (in the figure, Cdwnlim).

In the above way, according to the exhaust purification catalysts 20 and 24 used in the present embodiment, the purification characteristics of $NO_X$ and unburned gas in the exhaust gas change depending on the air-fuel ratio and stored amount of oxygen of the exhaust gas flowing into the exhaust purification catalysts 20 and 24. Note that, if having a catalytic action and oxygen storage ability, the exhaust purification catalysts 20 and 24 may also be catalysts different from three-way catalysts.

<Output Characteristic of Air-Fuel Ratio Sensor>

Figure 3:
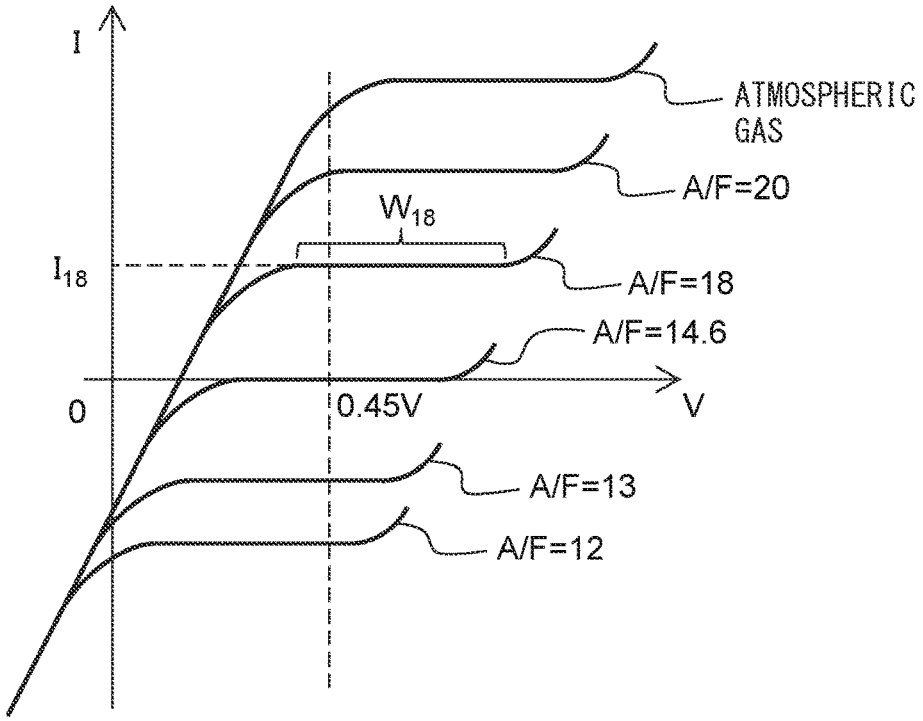
FIG. 3 is a view which shows the relationship between the voltage applied to the sensor and output current, at different exhaust air-fuel ratios.
Figure 4:
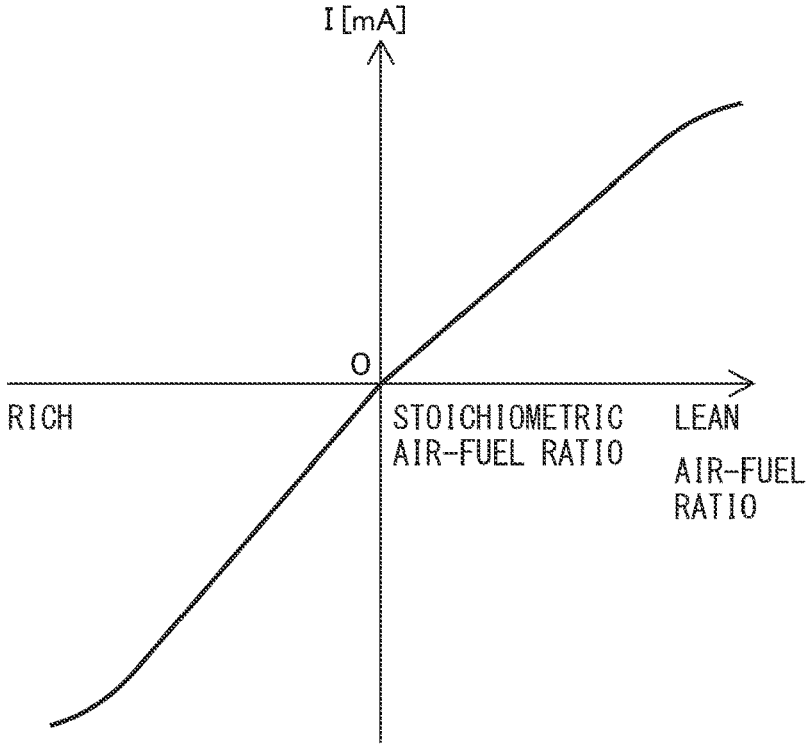
FIG. 4 is a view which shows the relationship between the exhaust air-fuel ratio and output current when making the voltage applied to the sensor constant.

Next, referring to FIGS. 3 and 4, the output characteristic of air-fuel ratio sensors 40 and 41 in the present embodiment will be explained. FIG. 3 is a view showing the voltage-current (V-I) characteristic of air-fuel ratio sensors 40 and 41 of the present embodiment. FIG. 4 is a view showing the relationship between air-fuel ratio of the exhaust gas (below, referred to as "exhaust air-fuel ratio") flowing around the air-fuel ratio sensors 40 and 41 and outputs current I when making the supplied voltage constant. Note that, in this embodiment, the air-fuel ratio sensor having the same configurations is used as both air-fuel ratio sensors 40 and 41.

As will be understood from FIG. 3, in the air-fuel ratio sensors 40 and 41 of the present embodiment, the output current I becomes larger the higher (the leaner) the exhaust air-fuel ratio. Further, at the line V-I of each exhaust air-fuel ratio, there is a region parallel to the V axis, that is, a region where the output current does not change much at all even if the sensor voltage changes. This voltage region is called the "limit current region". The current at this time is called the "limit current". In FIG. 3, the limit current region and limit current when the exhaust air-fuel ratio is 18 are shown by $W_{18}$ and $I_{18}$. Therefore, the air-fuel ratio sensors 40 and 41 can be referred to as limit current-type air-fuel ratio sensors.

FIG. 4 is a view which shows the relationship between the exhaust air-fuel ratio and the output current I when making the supplied voltage constant at about 0.45V. As will be understood from FIG. 4, in the air-fuel ratio sensors 40 and 41, the output current is linearly changed with respect to the exhaust air fuel ratio such that the higher the exhaust air-fuel ratio (that is, the leaner), the greater the output current I from the air-fuel ratio sensors 40 and 41. In addition, the air-fuel ratio sensors 40 and 41 are configured so that the output current I becomes zero when the exhaust air-fuel ratio is the stoichiometric air-fuel ratio. Further, when the exhaust air-fuel ratio becomes larger by a certain extent or more or when it becomes smaller by a certain extent or more, the ratio of change of the output current to the change of the exhaust air-fuel ratio becomes smaller.

Note that, in the above example, as the air-fuel ratio sensors 40 and 41, limit current type air-fuel ratio sensors of the structure shown in FIG. 3 are used. However, as the air-fuel ratio sensors 40, 41 for example, it is also possible to use a cup-type limit current type air-fuel ratio sensor or other structure of limit current type air-fuel ratio sensor or air-fuel ratio sensor not a limit current type or any other air-fuel ratio sensor, as long as the output current changes linearly with respect to the exhaust air-fuel ratio. Further, the air-fuel ratio sensors 40 and 41 may have a structure different from each other.

<Basic Air Fuel Ratio Control>

Next, an outline of the basic air-fuel ratio control in a control device of an internal combustion engine of the present embodiment will be explained. In the air-fuel ratio control in the present embodiment, the fuel feed amount from the fuel injectors 11 are controlled by feedback based on the output air-fuel ratio of the upstream side air-fuel ratio sensor 40 (corresponding to air-fuel ratio of exhaust gas flowing into the exhaust purification catalyst) so that the output air-fuel ratio of the upstream side air-fuel ratio sensor 40 becomes the target air-fuel ratio. Note that, "output air-fuel ratio" means air-fuel ratio corresponding to the output value of an air-fuel ratio sensor.

On the other hand, in the air-fuel control of the present embodiment, a target air-fuel ratio setting control for setting the target air-fuel ratio is performed based on the output air-fuel ratio of the downstream side air-fuel ratio sensor 41 etc. In the target air-fuel ratio setting control, when the output air-fuel ratio of the downstream side air-fuel ratio sensor 41 becomes the rich air-fuel ratio, the target air-fuel ratio is made the lean set air-fuel ratio. After this, it is maintained at this air-fuel ratio. Note that, the lean set air-fuel ratio is a predetermined air-fuel ratio which is leaner by a certain extent than the stoichiometric air-fuel ratio (an air-fuel ratio of center of control). For example, it is made about 14.65 to 20, preferably about 14.65 to 18, more preferably about 14.65 to 16. Further, the lean set air-fuel ratio can be expressed as an air-fuel ratio obtained by adding a lean correction amount to the air-fuel ratio of center of control (in the present embodiment, stoichiometric air-fuel ratio).

If the target air-fuel ratio is changed to the lean set air-fuel ratio, the oxygen excess/deficiency of the exhaust gas flowing into the upstream side exhaust purification catalyst 20 is cumulatively added. The "oxygen excess/deficiency" means the amount of the oxygen which becomes excessive or the amount of the oxygen which becomes deficient (amount of excess unburned gas etc.) when trying to make the air-fuel ratio of the exhaust gas flowing into the upstream side exhaust purification catalyst 20 the stoichiometric air-fuel ratio. In particular, when the target air-fuel ratio is the lean set air-fuel ratio, the exhaust gas flowing into the upstream side exhaust purification catalyst 20 becomes excessive in oxygen. This excess oxygen is stored in the upstream side exhaust purification catalyst 20. Therefore, the cumulative value of the oxygen excess/deficiency (below, also referred to as the "cumulative oxygen excess/deficiency") can be said to express the stored amount of oxygen OSA of the upstream side exhaust purification catalyst 20.

Note that, the oxygen excess/deficiency is calculated based on the output air-fuel ratio of the upstream side air-fuel ratio sensor 40 and the estimated value of the intake air amount to the inside of the combustion chamber 5 which is calculated based on the output of the airflow meter 39 etc. or the fuel feed amount of the fuel injector 11 etc. Specifically, the oxygen excess/deficiency OED is, for example, calculated by the following formula (1):

$$ODE=0.23\cdot Qi/(AFup\ 14.6) \quad (1)$$

where 0.23 indicates the concentration of oxygen in the air, Qi indicates the amount of fuel injection, and AFup indicates the air-fuel ratio corresponding to the output current Irup of the upstream side air-fuel ratio sensor 40.

If the thus calculated oxygen excess/deficiency becomes the predetermined switching reference value (corresponding to predetermined switching reference storage amount Cref) or more, the target air-fuel ratio, which had up to that time been the lean set air-fuel ratio, is made the rich set air-fuel ratio, then is maintained at this air-fuel ratio. The rich set air-fuel ratio is a predetermined air-fuel ratio which is richer than the stoichiometric air-fuel ratio (air-fuel ratio of center of control) in a certain degree. For example, it is about 12 to 14.58, preferably about 13 to 14.57, more preferably about 14 to 14.55. Further, the rich set air-fuel ratio can be expressed as an air-fuel ratio obtained by subtracting a rich correction amount from the air-fuel ratio of center of control (in the present embodiment, stoichiometric air-fuel ratio). Note that, in the present embodiment, the difference of the rich set air-fuel ratio from the stoichiometric air-fuel ratio (rich degree) is the difference of the lean set air-fuel ratio from the stoichiometric air-fuel ratio (lean degree) or less.

After this, when the output air-fuel ratio of the downstream side air-fuel ratio sensor 41 again becomes the rich judgment air-fuel ratio or less, the target air-fuel ratio is again made the lean set air-fuel ratio. After this, a similar operation is repeated. In this way, in the present embodiment, the target air-fuel ratio of the exhaust gas flowing into the upstream side exhaust purification catalyst 20 is alternately set to the lean set air-fuel ratio and the rich set air-fuel ratio.

However, even if performing the control stated above, the actual oxygen storage amount of the upstream side exhaust purification catalyst 20 may reach the maximum storable oxygen amount before the cumulative oxygen excess/deficiency reaches the switching reference value. As a reason for it, the reduction of the maximum storable oxygen amount of the upstream side exhaust purification catalyst 20 or significant temporal changes in the air-fuel ratio of the exhaust gas flowing into the upstream side exhaust purification catalyst 20 can be considered. If the oxygen storage amount reaches the maximum storable oxygen amount as such, the exhaust gas of lean air-fuel ratio flows out from the upstream side exhaust purification catalyst 20. Therefore, in the present embodiment, when the output air-fuel ratio of the downstream side air-fuel ratio sensor 41 becomes lean air-fuel ratio, the target air-fuel ratio is switched to the rich set air-fuel ratio. In particular, in the present embodiment, when the output air-fuel ratio of the downstream side air-fuel ratio sensor 41 becomes a lean judgment air-fuel ratio which is slightly leaner than the stoichiometric air-fuel ratio, it is judged that the output air-fuel ratio of the downstream side air-fuel sensor 41 becomes a lean air-fuel ratio.

<Explanation of Air Fuel Ratio Control Using Time Chart>

Figure 5:
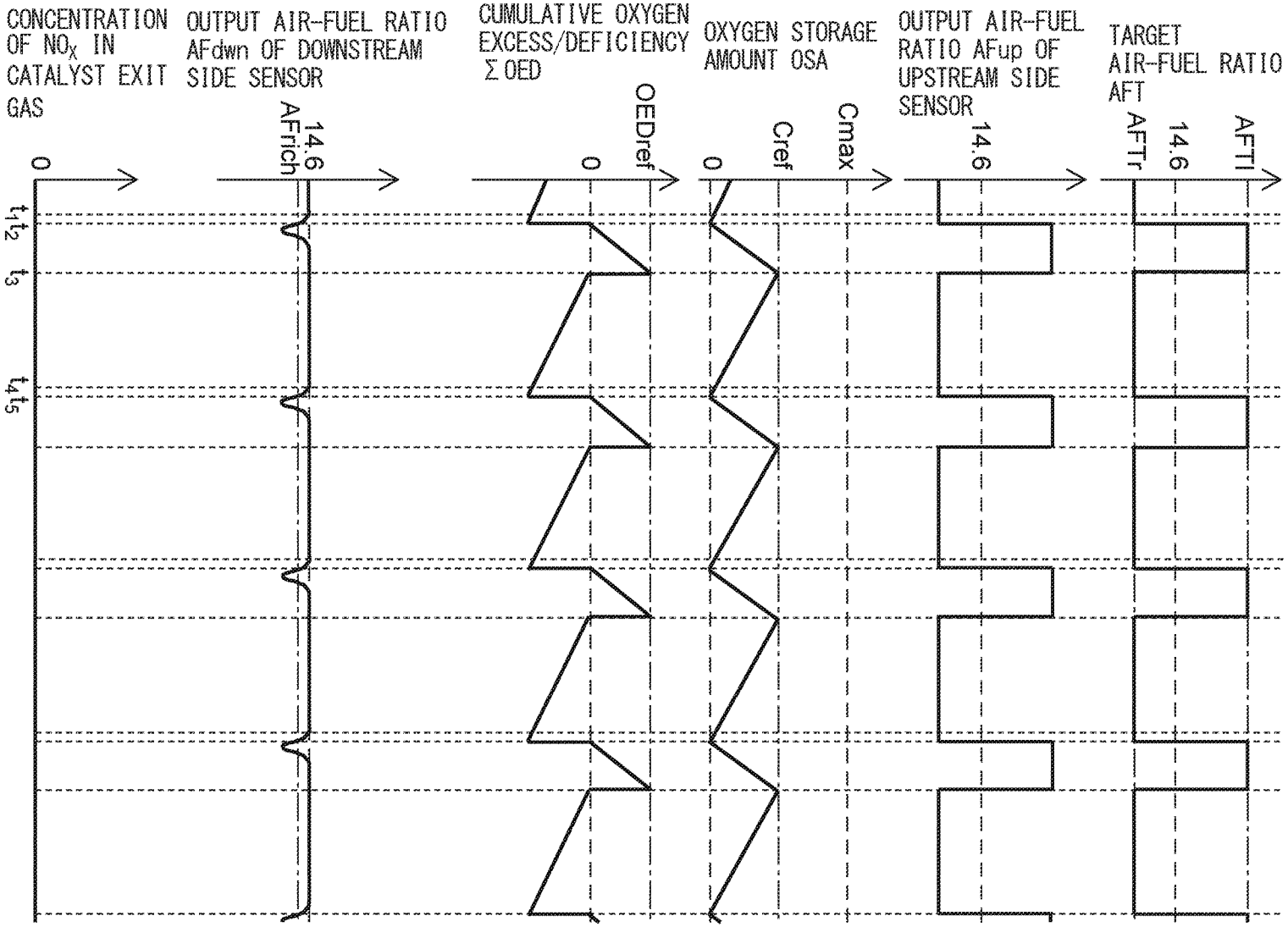
FIG. 5 is a time chart of a target air-fuel ratio etc. when performing the air-fuel ratio control.

Referring to FIG. 5, the operation explained as above will be explained in detail. FIG. 5 is a time chart of the target air-fuel ratio AFT, the output air-fuel ratio AFup of the upstream side air-fuel ratio sensor 40, the stored amount of oxygen OSA of the upstream side exhaust purification catalyst 20, the cumulative oxygen excess/deficiency ΣOED, the output air-fuel ratio AFdwn of the downstream side air-fuel ratio sensor 41, and the concentration of $NO_X$ in the exhaust gas flowing out from the upstream side exhaust purification catalyst 20, when performing the air-fuel ratio control of the present embodiment.

In the illustrated example, in the state before the time $t_1$, the target air-fuel ratio AFT is set to the rich set air-fuel ratio AFTr. Along with this, the output air-fuel ratio of the upstream side air-fuel ratio sensor 40 becomes a rich air-fuel ratio. Unburned gas contained in the exhaust gas flowing into the upstream side exhaust purification catalyst 20 is purified by the upstream side exhaust purification catalyst 20, and along with this the upstream side exhaust purification catalyst 20 is gradually decreased in the stored amount of oxygen OSA. Therefore, the cumulative oxygen excess/deficiency ΣOED is also gradually decreased. The unburned gas is not contained in the exhaust gas flowing out from the upstream side exhaust purification catalyst 20 by the purification at the upstream side exhaust purification catalyst 20, and therefore the output air-fuel ratio AFdwn of the downstream side air-fuel ratio sensor 41 becomes substantially stoichiometric air-fuel ratio. Further, since the air-fuel ratio of the exhaust gas flowing into the upstream side exhaust purification catalyst 20 becomes the rich air-fuel ratio, the amount of $NO_X$ exhausted from the upstream side exhaust purification catalyst 20 becomes substantially zero.

If the upstream side exhaust purification catalyst 20 gradually decreases in stored amount of oxygen OSA, the stored amount of oxygen OSA approaches zero at the time $t_1$. Along with this, part of the unburned gas flowing into the upstream side exhaust purification catalyst 20 starts to flow out without being purified by the upstream side exhaust purification catalyst 20. Due to this, from the time $t_1$ on, the output air-fuel ratio AFdwn of the downstream side air-fuel ratio sensor 41 gradually falls. As a result, at the time $t_2$, the output air-fuel ratio AFdwn of the downstream side air-fuel ratio sensor 41 reaches the rich judgment air-fuel ratio AFrich.

In the present embodiment, when the output air-fuel ratio AFdwn of the downstream side air-fuel ratio sensor 41 becomes the rich judgment air-fuel ratio AFrich or less, to increase the stored amount of oxygen OSA, the target air-fuel ratio AFT is switched to the lean set air-fuel ratio AFTl. Further, at this time, the cumulative oxygen excess/deficiency ΣOED is reset to 0.

When the target air-fuel ratio AFT is switched to the lean set air-fuel ratio AFTl at the time $t_2$, the air-fuel ratio of the exhaust gas flowing into the upstream side exhaust purification catalyst 20 changes from the rich air-fuel ratio to the lean air-fuel ratio. Further, along with this, the output air-fuel ratio AFup of the upstream side air-fuel ratio sensor 40 becomes a lean air-fuel ratio (in actuality, a delay occurs from when the target air-fuel ratio is switched to when the air-fuel ratio of the exhaust gas flowing into the upstream side exhaust purification catalyst 20 changes, but in the illustrated example, it is deemed for convenience that the change is simultaneous). If at the time $t_2$ the air-fuel ratio of the exhaust gas flowing into the upstream side exhaust purification catalyst 20 changes to the lean air-fuel ratio, the upstream side exhaust purification catalyst 20 increases in the stored amount of oxygen OSA. Further, along with this, the cumulative oxygen excess/deficiency ΣOED also gradually increases.

Due to this, the air-fuel ratio of the exhaust gas flowing out from the upstream side exhaust purification catalyst 20 changes to the stoichiometric air-fuel ratio, and the output air-fuel ratio AFdwn of the downstream side air-fuel ratio sensor 41 converges to the stoichiometric air-fuel ratio. At this time, the air-fuel ratio of the exhaust gas flowing into the upstream side exhaust purification catalyst 20 becomes the lean air-fuel ratio, but there is sufficient leeway in the oxygen storage ability of the upstream side exhaust purification catalyst 20, and therefore the oxygen in the inflowing exhaust gas is stored in the upstream side exhaust purification catalyst 20 and the $NO_X$ is reduced and purified. Therefore, the exhaust amount of $NO_X$ from the upstream side exhaust purification catalyst 20 becomes substantially zero.

After this, if the upstream side exhaust purification catalyst 20 increases in stored amount of oxygen OSA, at the time $t_3$, the stored amount of oxygen OSA of the upstream side exhaust purification catalyst 20 reaches the switching reference storage amount Cref. For this reason, the cumulative oxygen excess/deficiency ΣOED reaches the switching reference value OEDref which corresponds to the switching reference storage amount Cref. In the present embodiment, if the cumulative oxygen excess/deficiency ΣOED becomes the switching reference value OEDref or more, the storage of oxygen in the upstream side exhaust purification catalyst 20 is suspended by switching the target air-fuel ratio AFT to the rich set air-fuel ratio AFTr. Further, at this time, the cumulative oxygen excess/deficiency ΣOED is reset to 0.

In the example which is shown in FIG. 5, the stored amount of oxygen OSA falls simultaneously with the target air-fuel ratio being switched at the time $t_3$, but in actuality, a delay occurs from when the target air-fuel ratio is switched to when the stored amount of oxygen OSA falls. Further, the air-fuel ratio of the exhaust gas flowing into the upstream side exhaust purification catalyst 20 is sometimes unintentionally significantly shifted, for example, in the case where engine load becomes high by accelerating a vehicle provided with the internal combustion engine and thus the air intake amount is instantaneously significantly shifted. As opposed to this, the switching reference storage amount Cref is set sufficiently lower than the maximum storable oxygen amount Cmax when the upstream exhaust purification catalyst 20 is new. For this reason, even if such a delay occurs, or even if the air-fuel ratio is unintentionally and instantaneously shifted from the target air-fuel ratio, the stored amount of oxygen OSA does not basically reach the maximum storable oxygen amount Cmax. Conversely, the switching reference storage amount Cref is set to an amount sufficiently small so that the stored amount of oxygen OSA does not reach the maximum storable oxygen amount Cmax even if a delay or unintentional shift in air-fuel ratio occurs. For example, the switching reference storage amount Cref is ¾ or less of the maximum storable oxygen amount Cmax when the upstream side exhaust purification catalyst 20 is new, preferably ½ or less, more preferably ⅕ or less.

If the target air-fuel ratio AFT is switched to the rich set air-fuel ratio AFTr at the time $t_3$, the air-fuel ratio of the exhaust gas flowing into the upstream side exhaust purification catalyst 20 changes from the lean air-fuel ratio to the rich air-fuel ratio. Along with this, the output air-fuel ratio AFup of the upstream side air-fuel ratio sensor 40 becomes a rich air-fuel ratio (in actuality, a delay occurs from when the target air-fuel ratio is switched to when the exhaust gas flowing into the upstream side exhaust purification catalyst 20 changes in air-fuel ratio, but in the illustrated example, it is deemed for convenience that the change is simultaneous). The exhaust gas flowing into the upstream side exhaust purification catalyst 20 contains unburned gas, and therefore the upstream side exhaust purification catalyst 20 gradually decreases in stored amount of oxygen OSA. At the time $t_4$, in the same way as the time $t_1$, the output air-fuel ratio AFdwn of the downstream side air-fuel ratio sensor 41 starts to fall. At this time as well, the air-fuel ratio of the exhaust gas flowing into the upstream side exhaust purification catalyst 20 is the rich air-fuel ratio, and therefore $NO_X$ exhausted from the upstream side exhaust purification catalyst 20 is substantially zero.

Next, at the time $t_5$, in the same way as time $t_2$, the output air-fuel ratio AFdwn of the downstream side air-fuel ratio sensor 41 reaches the rich judgment air-fuel ratio AFrich. Due to this, the target air-fuel ratio AFT is switched to the lean set air-fuel ratioAFTl. After this, the cycle of the above mentioned times $t_1$ to $t_5$ is repeated.

As will be understood from the above explanation, according to the present embodiment, it is possible to constantly suppress the amount of $NO_X$ exhausted from the upstream side exhaust purification catalyst 20. That is, as long as performing the control explained above, the exhaust amount of $NO_X$ from the upstream side exhaust purification catalyst 20 can basically be zero. Further, since the cumulative period for calculating the cumulative oxygen excess/deficiency ΣOED is short, comparing with the case where the cumulative period is long, a possibility of error occurring is low. Therefore, it is suppressed that $NO_X$ is exhausted from the upstream side exhaust purification catalyst 20 due to the calculation error in the cumulative oxygen excess/deficiency ΣOED.

Further, in general, if the stored amount of oxygen of the exhaust purification catalyst is maintained constant, the exhaust purification catalyst falls in oxygen storage ability. That is, it is necessary that the oxygen storage amount of the exhaust purification catalyst is varied in order to maintain the oxygen storage ability of the exhaust purification catalyst high. On the other hand, according to the present embodiment, as shown in FIG. 5, the stored amount of oxygen OSA of the upstream side exhaust purification catalyst 20 constantly fluctuates up and down, and therefore the oxygen storage ability is kept from falling.

Note that, in the above embodiment, the target air-fuel ratio AFT is maintained to the constant lean set air-fuel ratio AFTl in the time $t_2$ to $t_3$. However, in this period, the lean set air-fuel ratio AFTl is not necessarily maintained constant, and can be set so as to vary, for example to be gradually reduced. Alternatively, in the period from the time $t_2$ to time $t_3$, the lean set air-fuel ratio AFTl may be temporally set to the rich air-fuel ratio.

Similarly, in the above embodiment, the target air-fuel ratio AFT is maintained to the constant rich set air-fuel ratio AFTr in the time $t_3$ to $t_5$. However, in this period, the rich set air-fuel ratio AFTr is not necessarily maintained constant, and can be set so as to vary, for example to be gradually increased. Alternatively, in the period from the time $t_3$ to $t_5$, the rich set air-fuel ratio AFTr may be temporally set to the lean air-fuel ratio.

However, even in this case, the target air-fuel ratio in the time $t_2$ to $t_3$ is set so that the difference between the average value of the target air-fuel ratio at this period and the stoichiometric air-fuel ratio is larger than the difference between the average value of the target air-fuel ratio in the time $t_3$ to $t_5$ and the stoichiometric air-fuel ratio.

Note that, in the present embodiment, setting of the target air-fuel ratio is performed by the ECU 31. Therefore, it can be said that when the air-fuel ratio of the exhaust gas detected by the downstream side air-fuel ratio sensor 41 becomes the rich judgment air-fuel ratio or less, the ECU 31 makes the target air-fuel ratio of the exhaust gas flowing into the upstream side exhaust purification catalyst 20 the lean air-fuel ratio continuously or intermittently until the stored amount of oxygen OSA of the upstream side exhaust purification catalyst 20 becomes the switching reference storage amount Cref, and when the stored amount of oxygen OSA of the upstream side exhaust purification catalyst 20 becomes the switching reference storage amount Cref or more the ECU 31 makes the target air-fuel ratio the rich air-fuel ratio continuously or intermittently until the air-fuel ratio of the exhaust gas detected by the downstream side air-fuel ratio sensor 41 becomes the rich judgment air-fuel ratio or less without the stored amount of oxygen OSA reaching the maximum storable oxygen amount Cmaxn.

More simply speaking, in the present embodiment, it can be said that the ECU 31 switches the target air-fuel ratio to the lean air-fuel ratio when the air-fuel ratio detected by the downstream side air-fuel ratio sensor 41 becomes the rich judgment air-fuel ratio or less and switches the target air-fuel ratio to the rich air-fuel ratio when the stored amount of oxygen OSA of the upstream side exhaust purification catalyst 20 becomes the switching reference storage amount Cref or more.

Further, in the above embodiment, the cumulative oxygen excess/deficiency ΣOED is calculated, based on the output air-fuel ratio AFup of the upstream air-fuel ratio sensor 40 and the estimated value of the air intake amount to the combustion chamber 6, etc. However, the stored amount of oxygen OSA may also be calculated based on parameters other than these parameters and may be estimated based on parameters which are different from these parameters. Further, in the above embodiment, if the estimated value of the oxygen storage amount OSA becomes the switching reference storage amount Cref or more, the target air-fuel ratio is switched from the lean set air-fuel ratio to the rich set air-fuel ratio. However, the timing of switching the target air-fuel ratio from the lean set air-fuel ratio to the rich set air-fuel ratio may, for example, also be based on the engine operating time from when switching the target air-fuel ratio from the rich set air-fuel ratio to the lean set air-fuel ratio or other parameter. However, even in this case, the target air-fuel ratio has to be switched from the lean set air-fuel ratio to the rich set air-fuel ratio while the stored amount of oxygen OSA of the upstream side exhaust purification catalyst 20 is estimated to be smaller than the maximum storable oxygen amount.

<Characteristic Relating to Storage of Sulfur Ingredients>

In this regard, the above-mentioned switching reference storage amount Cref is set sufficiently lower than the maximum storable oxygen amount Cmax when the upstream side exhaust purification catalyst 20 is a new catalyst. For this reason, so long as the maximum storable oxygen amount Cmax is maintained high, the oxygen storage amount OSA of the upstream side exhaust purification catalyst 20 almost never reaches the maximum storable oxygen amount Cmax. However, the maximum storable oxygen amount Cmax of the upstream side exhaust purification catalyst 20 is not constantly fixed and falls due to the deterioration of the upstream side exhaust purification catalyst 20. As one factor causing a drop in the maximum storable oxygen amount Cmax in this way, storage of the sulfur ingredients in the upstream side exhaust purification catalyst 20 may be mentioned.

In general, exhaust gas discharged from a combustion chamber 5 contains small amounts of sulfur ingredients including SOx. Accordingly, exhaust gas containing these sulfur ingredients flows into the upstream side exhaust purification catalyst 20. At the upstream side exhaust purification catalyst 20, if the inflowing exhaust gas contains sulfur ingredients, depending on the temperature of the upstream side exhaust purification catalyst 20 or other conditions, the sulfur ingredients will be stored. If the upstream side exhaust purification catalyst 20 stores the sulfur ingredients in this way, the maximum storable oxygen amount Cmax of the upstream side exhaust purification catalyst 20 will be decreased by that amount. Therefore, to maintain the maximum storable oxygen amount Cmax of the upstream side exhaust purification catalyst 20 high, it is necessary to keep the amount of storage of sulfur ingredients of the upstream side exhaust purification catalyst 20 low.

Whether or not the upstream side exhaust purification catalyst 20 stores sulfur ingredients greatly changes depending on the temperature of the upstream side exhaust purification catalyst 20. When the temperature of the upstream side exhaust purification catalyst 20 is a certain sulfur storage upper limit temperature (for example, 600° C.) or less, if the air-fuel ratio of the exhaust gas flowing into the upstream side exhaust purification catalyst 20 is a lean air-fuel ratio, the sulfur ingredients in the inflowing exhaust gas are stored in the upstream side exhaust purification catalyst 20. On the other hand, at this time as well, if the air-fuel ratio of the exhaust gas flowing into the upstream side exhaust purification catalyst 20 is a rich air-fuel ratio, even if the inflowing exhaust gas contains sulfur ingredients, the upstream side exhaust purification catalyst 20 will not store almost any of the sulfur ingredients. On the other hand, when the temperature of the upstream side exhaust purification catalyst 20 is the sulfur storage upper limit temperature or more, regardless of the air-fuel ratio of the exhaust gas flowing into the upstream side exhaust purification catalyst 20, the upstream side exhaust purification catalyst 20 will not store the sulfur ingredients.

<Control of Rich Set Air-Fuel Ratio and Lean Set Air-Fuel Ratio>

Therefore, in an embodiment of the present invention, the difference of the lean set air-fuel ratio from the stoichiometric air-fuel ratio (lean degree) and the difference of the rich set air-fuel ratio from the stoichiometric air-fuel ratio (rich degree) are changed in accordance with the temperature of the upstream side exhaust purification catalyst 20.

Figure 6:
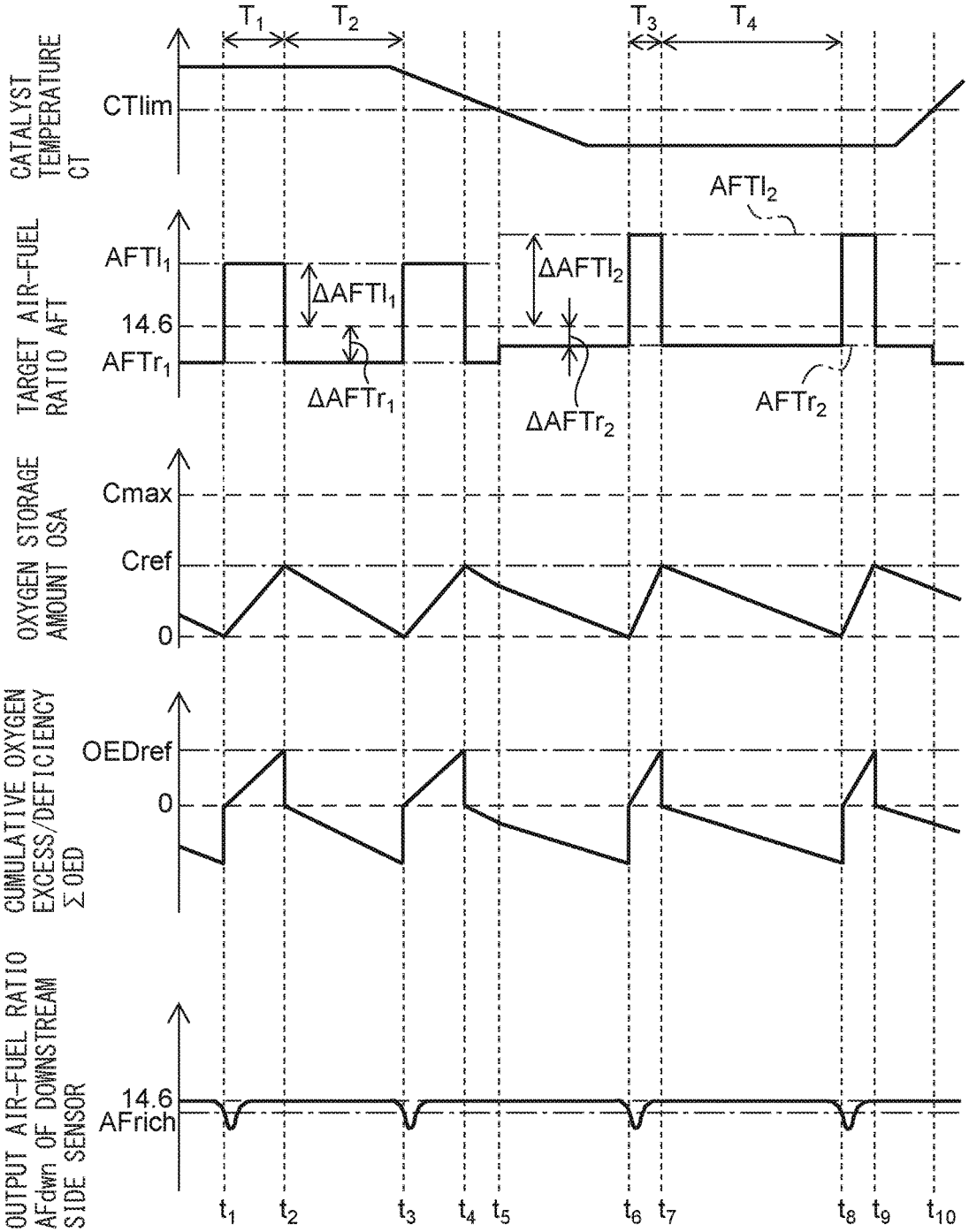
FIG. 6 is a time chart of a target air-fuel ratio etc. when performing control to change a rich set air-fuel ratio and a lean set air-fuel ratio in the present embodiment.

FIG. 6 is a time chart of a target air-fuel ratio AFT etc. when performing control to change the rich set air-fuel ratio and the lean set air-fuel ratio (below, referred to together as the "set air-fuel ratios") in the present embodiment. In the example shown in FIG. 6, basically air-fuel ratio control similar to FIG. 5 is performed.

In the example shown in FIG. 6, before the time $t_5$, the temperature CT of the upstream side exhaust purification catalyst 20 becomes a temperature higher than the sulfur storage upper limit temperature CTlim. At this time, the rich set air-fuel ratio AFTr and the lean set air-fuel ratio AFTl are respectively set to a first rich set air-fuel ratio $AFTr_1$ and a first lean set air-fuel ratio $AFTl_1$. Here, the difference of the first rich set air-fuel ratio $AFTr_1$ from the stoichiometric air-fuel ratio is the first rich degree $\Delta AFTr_1$. Further, the difference of the first lean set air-fuel ratio $AFTl_1$ from the stoichiometric air-fuel ratio is the first lean degree $\Delta AFTl_1$.

Therefore, at the time $t_1$, if the output air-fuel ratio AFdwn of the downstream side air-fuel ratio sensor 41 becomes the rich judgment air-fuel ratio AFrich or less, the target air-fuel ratio AFT is switched to the first lean set air-fuel ratio $AFTl_1$. After that, if the oxygen storage amount OSA of the upstream side exhaust purification catalyst 20 becomes the switching reference storage amount Cref or more, that is, if the cumulative oxygen excess/deficiency ΣOED becomes the switching reference value OEDref or more, the target air-fuel ratio AFT is switched to the first rich set air-fuel ratio $AFTr_1$. After that, this cycle is repeated up to the time $t_5$.

After that, at the time $t_5$, if the temperature CT of the upstream side exhaust purification catalyst 20 becomes the sulfur storage upper limit temperature CTlim or less, the values of the rich set air-fuel ratio AFTr and the lean set air-fuel ratio AFTl are changed. In the example shown in FIG. 6, the rich set air-fuel ratio AFTr is changed from the first rich set air-fuel ratio $AFTr_1$ to the second rich set air-fuel ratio $AFTr_2$. The difference of the second rich set air-fuel ratio $AFTr_2$ from the stoichiometric air-fuel ratio is the second rich degree $\Delta AFTr_2$ which is smaller than the first rich degree $\Delta AFTr_1$. Therefore, the second rich set air-fuel ratio $AFTr_2$ is a air-fuel ratio larger (leaner) than the first rich set air-fuel ratio $AFTr_1$.

In addition, in the example shown in FIG. 6, at the time $t_5$, the lean set air-fuel ratio AFTl is changed from the first lean set air-fuel ratio $AFTl_1$ to the second lean set air-fuel ratio $AFTl_2$. The difference of the second lean set air-fuel ratio $AFTl_2$ from the stoichiometric air-fuel ratio is the second lean degree $\Delta AFTl_2$ which is larger than the first lean degree $\Delta AFTl_1$. Therefore, the second lean set air-fuel ratio $AFTl_2$ is the air-fuel ratio which is larger (leaner) than the first lean set air-fuel ratio $AFTl_1$.

Here, the value of the first lean degree $\Delta AFTl_1$ minus the first rich degree $\Delta AFTr_1$ before the time $t_5$ is defined as the first variation difference $\Delta LR_1$ ($\Delta LR_1=\Delta AFTl_1-\Delta AFTr_1$. Similarly, the value of the second lean degree $\Delta AFTl_2$ minus the second rich degree $\Delta AFTr_2$ after the time $t_5$ is defined as the second variation difference $\Delta LR_2$ ($\Delta LR_2=\Delta AFTl_2-\Delta AFTr_2$). In this case, in an embodiment of the present invention, the second variation difference $\Delta LR_2$ is set to the value of the first variation difference $\Delta LR_1$ or more ($\Delta LR_2 \geq \Delta LR_1$).

After that, while the temperature CT of the upstream side exhaust purification catalyst 20 is the sulfur storage upper limit temperature CTlim or less, the rich set air-fuel ratio AFTr is maintained at the second rich set air-fuel ratio $AFTr_2$, and the lean set air-fuel ratio AFTl is maintained at the second lean set air-fuel ratio $AFTl_2$. Further, if the temperature CT of the upstream side exhaust purification catalyst 20 again changes to a temperature higher than the sulfur storage upper limit temperature CTlim at the time $t_{10}$, the rich set air-fuel ratio AFTr is changed to the first rich set air-fuel ratio $AFTr_1$, while the lean set air-fuel ratio AFTl is changed to the first lean set air-fuel ratio $AFTl_1$.

<Effects of Set Air-Fuel Ratio Control>

In this way, in the present embodiment, when the temperature CT of the upstream side exhaust purification catalyst 20 is the sulfur storage upper limit temperature CTlim or less, compared to when it is higher than the sulfur storage upper limit temperature CTlim, the variation difference ΔLR of the lean degree of the lean set air-fuel ratio minus the rich degree of the rich set air-fuel ratio is set greater. Below, the effects of controlling the rich set air-fuel ratio and the lean set air-fuel ratio in this way will be explained.

As shown in FIG. 6, the time from when the output air-fuel ratio AFdwn of the downstream side air-fuel ratio sensor 41 reaches the rich judgment air-fuel ratio AFrich to when the oxygen storage amount OSA reaches the switching reference storage amount Cref, when the temperature CT of the upstream side exhaust purification catalyst 20 is higher than the sulfur storage upper limit temperature CTlim, is defined as $T_1$ (for example, the times $t_1$ to $t_2$). Similarly, the time from when the oxygen storage amount OSA reaches the switching reference storage amount Cref to when the output air-fuel ratio AFdwn of the downstream side air-fuel ratio sensor 41 reaches the rich judgment air-fuel ratio AFrich is defined as $T_2$ (for example, the times $t_2$ to $t_3$). Therefore, the time taken for one cycle from the output air-fuel ratio AFdwn of the downstream side air-fuel ratio sensor 41 reaching the rich judgment air-fuel ratio AFrich to then again reaching the rich judgment air-fuel ratio AFrich is expressed as $T_1+T_2$ (for example, the times $t_1$ to $t_3$).

On the other hand, the time from when the output air-fuel ratio AFdwn of the downstream side air-fuel ratio sensor 41 reaches the rich judgment air-fuel ratio AFrich to when the oxygen storage amount OSA reaches the switching reference storage amount Cref, when the temperature CT of the upstream side exhaust purification catalyst 20 is the sulfur storage upper limit temperature CTlim or less, is defined as $T_3$ (for example, the times $t_6$ to $t_7$). Similarly, the time from when the oxygen storage amount OSA reaches the switching reference storage amount Cref to when the output air-fuel ratio AFdwn of the downstream side air-fuel ratio sensor 41 reaches the rich judgment air-fuel ratio AFrich is defined as $T_4$ (for example, the times $t_7$ to $t_3$). Therefore, the time taken for one cycle from the output air-fuel ratio AFdwn of the downstream side air-fuel ratio sensor 41 reaching the rich judgment air-fuel ratio AFrich to then again reaching the rich judgment air-fuel ratio AFrich is expressed as $T_3+T_4$ (for example, the times $t_6$ to $t_8$).

As will be understood from FIG. 6, in the present embodiment, when the temperature of the upstream side exhaust purification catalyst 20 is high (in the figure, before the time $t_5$), the ratio of the time $T_1$ in one cycle of time ($T_1+T_2$) does not become that low. That is, the time in one cycle of time in which the air-fuel ratio of the exhaust gas flowing into the upstream side exhaust purification catalyst 20 is the lean air-fuel ratio (below, referred to as the "lean time") is not that short. As opposed to this, when the temperature of the upstream side exhaust purification catalyst 20 is low (in the figure, the times $t_5$ to $t_{10}$), the ratio of the time $T_3$ in one cycle of time ($T_3+T_4$) becomes extremely low. That is, in one cycle of time, the lean time becomes short. This is because the variation difference ΔLR is set large when the temperature CT of the upstream side exhaust purification catalyst 20 is low.

As explained above, at the upstream side exhaust purification catalyst 20, if the temperature CT becomes the sulfur storage upper limit temperature CTlim or less, when the air-fuel ratio of the exhaust gas flowing into the upstream side exhaust purification catalyst 20 is the lean air-fuel ratio, the sulfur ingredients are stored. In the present embodiment, when the temperature of the upstream side exhaust purification catalyst 20 is low, the time during which the air-fuel ratio of the exhaust gas flowing into the upstream side exhaust purification catalyst 20 is the lean air-fuel ratio becomes short, and therefore the upstream side exhaust purification catalyst 20 is kept from storing the sulfur ingredients.

On the other hand, in the present embodiment, when the temperature of the upstream side exhaust purification catalyst 20 is high, in one cycle of time, the lean time is not that short. However, as explained above, in the upstream side exhaust purification catalyst 20, when the temperature CT is higher than the sulfur storage upper limit temperature CTlim, even if the air-fuel ratio of the exhaust gas is the lean air-fuel ratio, the upstream side exhaust purification catalyst 20 does not store almost any sulfur ingredients at all. Therefore, even if the time during which the air-fuel ratio of the exhaust gas is the lean air-fuel ratio is not that short, the upstream side exhaust purification catalyst 20 does not store almost any sulfur ingredients at all. From the above, according to the present embodiment, the upstream side exhaust purification catalyst 20 can be kept from storing the sulfur ingredients and accordingly the upstream side exhaust purification catalyst 20 can be kept low in amount of storage of sulfur ingredients.

Figure 7:
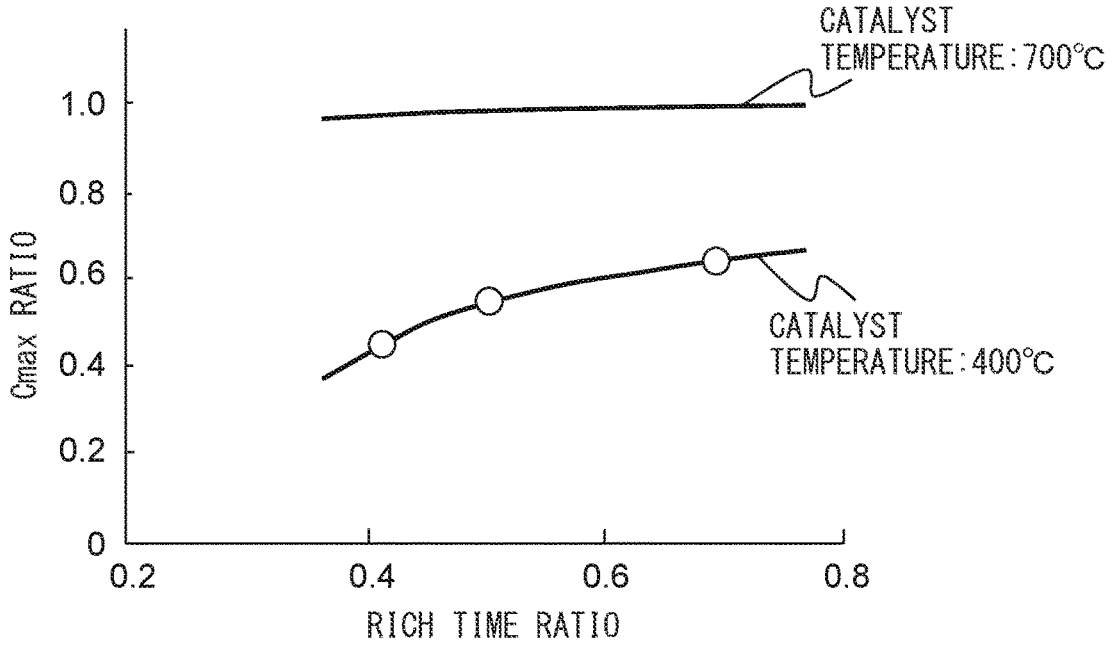
FIG. 7 is a graph which expresses a Cmax ratio with respect to a ratio of a rich time in one cycle.

Experimental results relating to this are shown in FIG. 7. FIG. 7 is a graph which shows the relationship between the ratio of the rich time in one cycle of time (for example, $T_2/(T_1+T_2)$ or $T_4/(T_3+T_4)$) and the Cmax ratio. The graph shown in FIG. 7 is obtained by operating an internal combustion engine using a new exhaust purification catalyst and maintaining the ratio of the rich time in one cycle constant and expresses how the maximum storable oxygen amount Cmax changes as a result. The Cmax ratio in the figure expresses the ratio of the maximum storable oxygen amount Cmax when defining the maximum storable oxygen amount Cmax at the time of a new catalyst as "1".

As will be understood from FIG. 7, when the temperature of the exhaust purification catalyst is low (400° C.), if the ratio of the rich time becomes greater, that is, if the ratio of the lean time becomes smaller, the Cmax ratio increases. This supports the thinking that the smaller the ratio of the lean time, the more difficult it becomes for the exhaust purification catalyst to store the sulfur ingredients. On the other hand, if the temperature of the exhaust purification catalyst is high (700° C.), the Cmax ratio is higher than when the temperature of the exhaust purification catalyst is low and is substantially constant regardless of the ratio of the rich time. Therefore, from the graph shown in FIG. 7 as well, according to the present embodiment, the thinking that storage of the sulfur ingredients in the upstream side exhaust purification catalyst 20 can be suppressed is supported.

Note that, in the above embodiment, from when the output air-fuel ratio AFdwn of the downstream side air-fuel ratio sensor 41 reaches the rich judgment air-fuel ratio AFrich to when the oxygen storage amount OSA reaches the switching reference storage amount Cref (for example, the times $t_1$ to $t_2$, $t_6$ to $t_7$), the target air-fuel ratio AFT is maintained constant. That is, the lean set air-fuel ratio is maintained constant. However, the lean set air-fuel ratio is not necessarily constant and may fluctuate by a certain extent. However, in this case as well, the lean degree of the average value of the lean set air-fuel ratios at the times $t_6$ to $t_7$ is set larger than the lean degree of the average value of the lean set air-fuel ratios at the times $t_1$ to $t_2$.

Similarly, in the above embodiment, from when the oxygen storage amount OSA reaches the switching reference storage amount Cref to when the output air-fuel ratio AFdwn of the downstream side air-fuel ratio sensor 41 reaches the rich judgment air-fuel ratio AFrich (for example, the times $t_2$ to $t_3$, $t_7$ to $t_8$), the target air-fuel ratio AFT is maintained constant. That is, the rich set air-fuel ratio is maintained constant. However, the rich set air-fuel ratio need not necessarily be constant and may fluctuate by a certain extent. However, in this case as well, the rich degree of the average value of the rich set air-fuel ratios at the times $t_7$ to $t_8$ is set smaller than the rich degree of the average value of the rich set air-fuel ratios at the times $t_2$ to $t_3$.

Further, in the above-mentioned example, when the temperature CT of the upstream side exhaust purification catalyst 20 is the sulfur storage upper limit temperature CTlim or less, both of the rich set air-fuel ratio AFTr and the lean set air-fuel ratio AFTl are changed. However, it is also possible to not change both set air-fuel ratios and to change only one of them.

Figure 8:
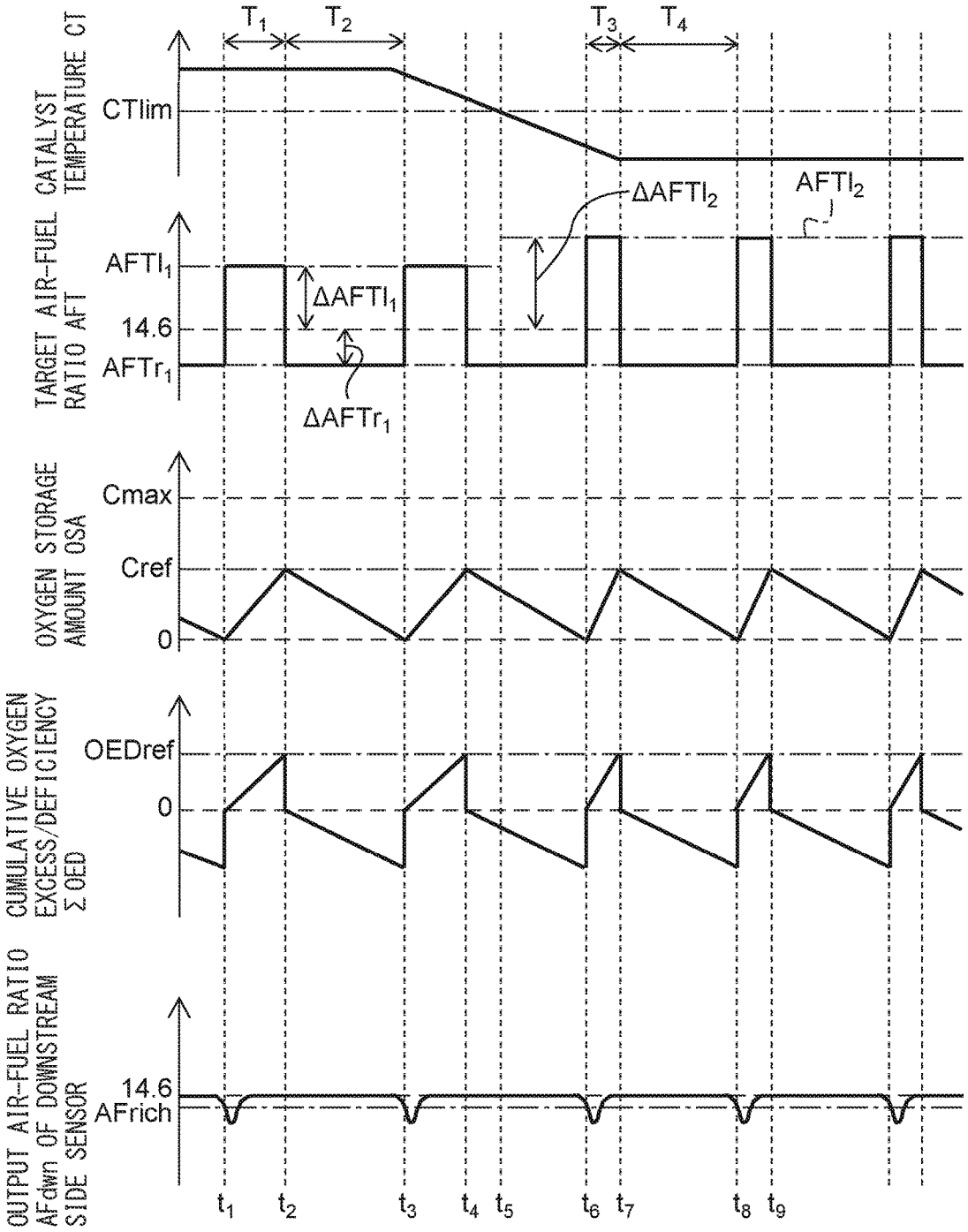
FIG. 8 is a time chart of a target air-fuel ratio etc. similar to FIG. 6.

FIG. 8 shows an example where when the temperature CT of the upstream side exhaust purification catalyst 20 is the sulfur storage upper limit temperature CTlim or less, only the lean set air-fuel ratio AFTl is changed from the first lean set air-fuel ratio $AFTl_1$ to the second lean set air-fuel ratio $AFTl_2$ while the rich set air-fuel ratio AFTr is maintained constant. In this case as well, the second variation difference of $\Delta LR_2$ ($=\Delta AFTl_2-\Delta AFTr_1$) is a value larger than the first variation difference $\Delta LR_1$ ($=\Delta AFTl_1-\Delta AFTr_1$) ($\Delta LR_2>\Delta LR_1$). As a result, when the temperature CT of the upstream side exhaust purification catalyst 20 is high, the ratio of the lean time can be increased and accordingly the storage of the sulfur ingredients in the upstream side exhaust purification catalyst 20 can be suppressed.

Figure 9:
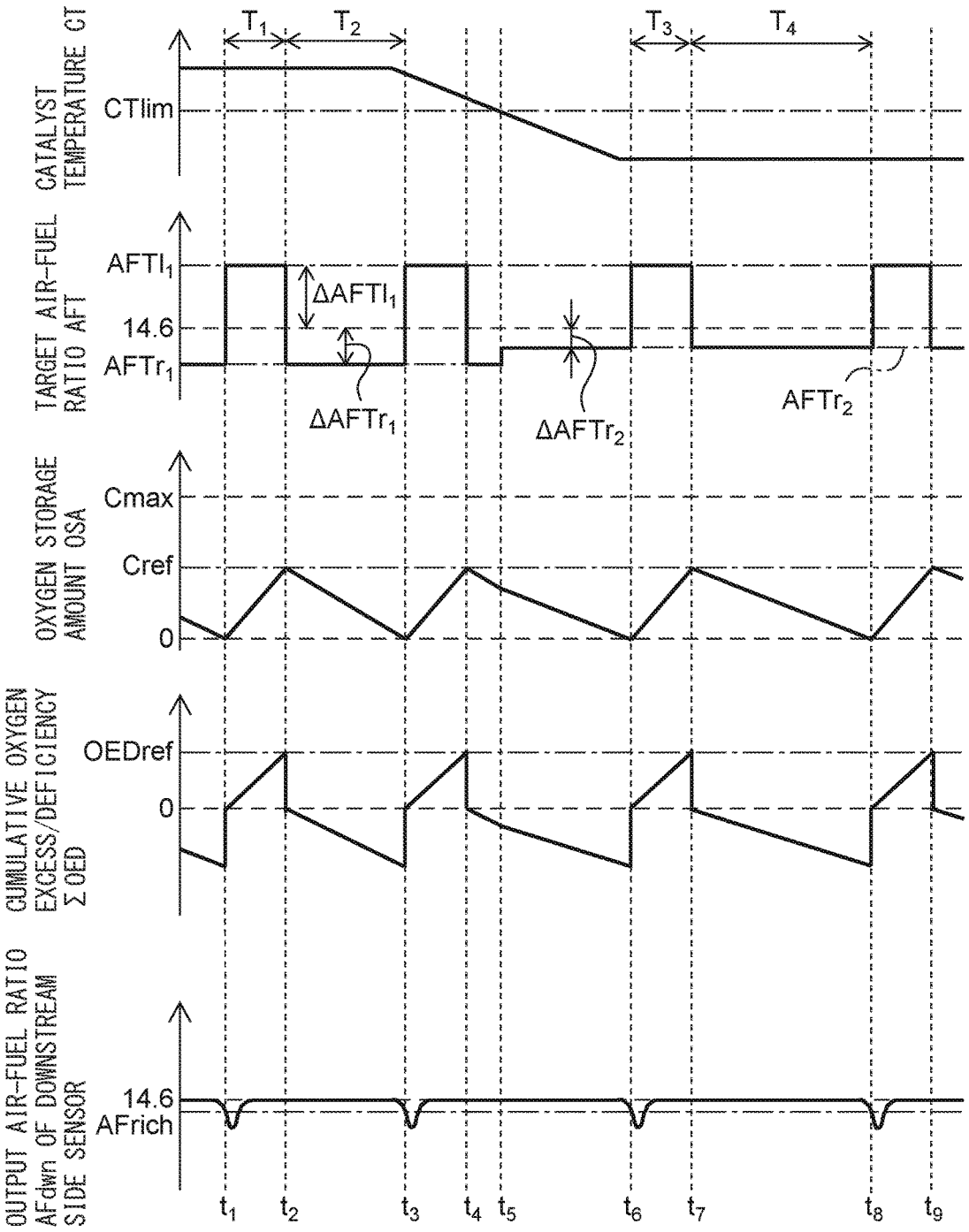
FIG. 9 is a time chart of a target air-fuel ratio etc. similar to FIG. 6.

FIG. 9 shows an example where when the temperature CT of the upstream side exhaust purification catalyst 20 is the sulfur storage upper limit temperature CTlim or less, only the rich set air-fuel ratio AFTr is changed from the first rich set air-fuel ratio $AFTr_1$ to the second rich set air-fuel ratio $AFTr_2$ while the lean set air-fuel ratio AFTl is maintained constant. In this case as well, the second variation difference of $\Delta LR_2$ ($=\Delta AFTl_2-\Delta AFTr_1$) is a value larger than the first variation difference $\Delta LR_1$ ($=\Delta AFTl_1-\Delta AFTr_1$) ($\Delta LR_2>\Delta LR$). As a result, in the example shown in FIG. 9 as well, when the temperature CT of the upstream side exhaust purification catalyst 20 is high, the ratio of the lean time can be increased and accordingly the storage of the sulfur ingredients in the upstream side exhaust purification catalyst 20 can be suppressed.

Further, in the above embodiment, the rich set air-fuel ratio and the lean set air-fuel ratio are changed when the temperature CT of the upstream side exhaust purification catalyst 20 becomes the sulfur storage upper limit temperature CTlim. However, the temperature for switching the set air-fuel ratios does not necessarily have to be the sulfur storage upper limit temperature CTlim and may be a temperature lower than this as well. Further, the temperature of the upstream side exhaust purification catalyst 20 need not necessarily be a value obtained by providing an upstream side temperature sensor 46 and actually detecting the temperature. The temperature of the upstream side exhaust purification catalyst 20 may be estimated based on other parameters relating the temperature of the upstream side exhaust purification catalyst 20 (for example, the intake air amount etc. such as in the later explained second embodiment).

<Flow Chart>

Figure 10:
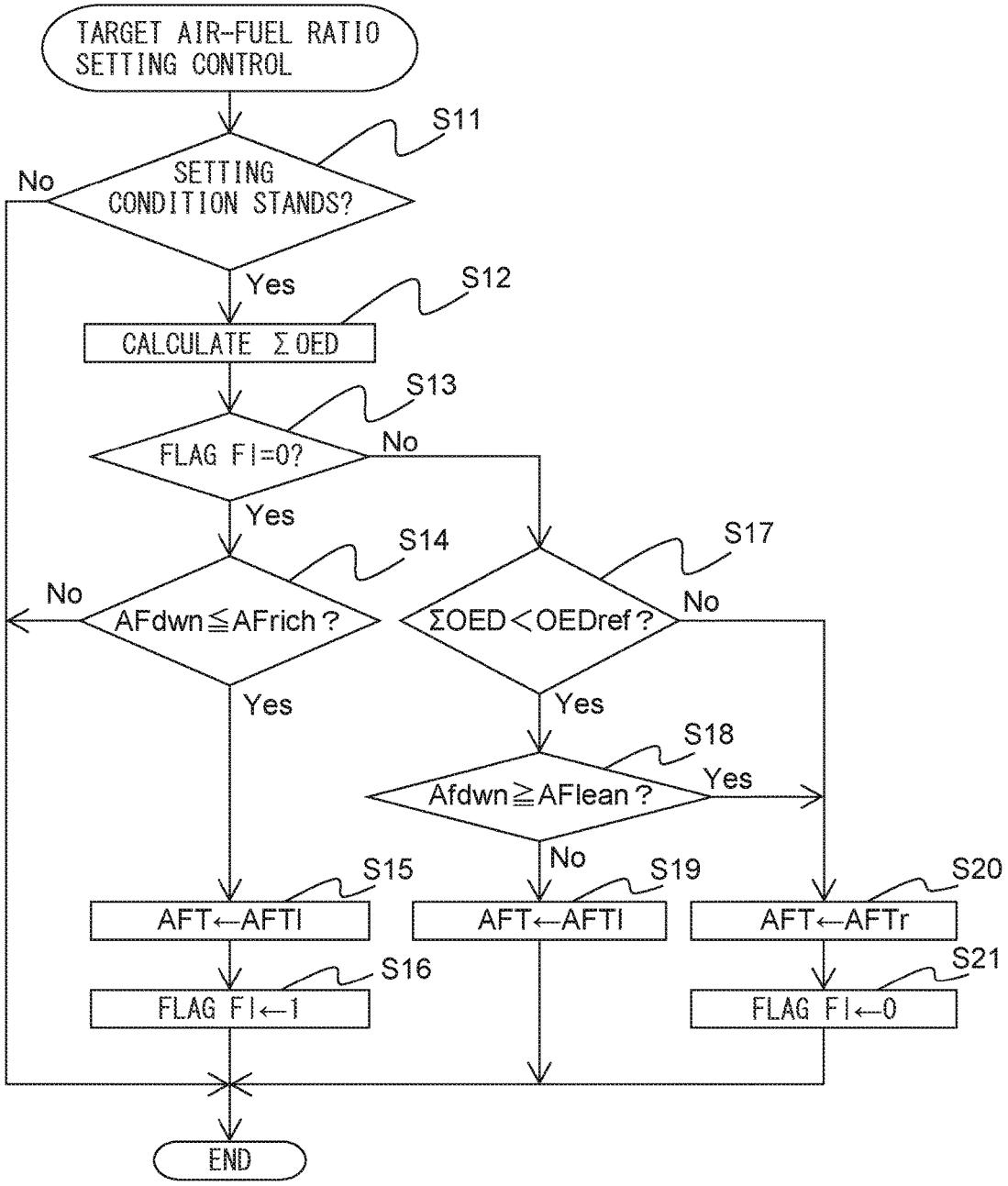
FIG. 10 is a flow chart which shows a control routine in target air-fuel ratio setting control.

FIG. 10 is a flow chart showing a control routine at the target air-fuel ratio setting control. The illustrated control routine is performed by interruption every certain time interval.

As shown in FIG. 10, first, at step S11, it is judged if the condition for setting the target air-fuel ratio AFT stands. As the case where the condition for setting the target air-fuel ratio AFT stands, the engine operation in ordinary control, for example, the engine operation not in the fuel cut control etc. may be mentioned. When it is judged at step S11 that the condition for setting the target air-fuel ratio stands, the routine proceeds to step S12. At step S12, the cumulative oxygen excess/deficiency ΣOED is calculated based on the output air-fuel ratio of the upstream side air-fuel ratio sensor 40 and the fuel injection quantity Qi.

Next, at step S13, it is judged if a lean setting flag F1 is set to 0. The lean setting flag F1 is a flag which is set to 1 when the target air-fuel ratio AFT is set to the lean set air-fuel ratio AFTl and is set to 0 at other times. When it is judged at step S13 that the lean setting flag F1 is set to 0, that is, when the target air-fuel ratio AFT is set to the rich set air-fuel ratio AFTr, the routine proceeds to step S14. At step S14, it is judged if the output air-fuel ratio AFdwn of the downstream side air-fuel ratio sensor 41 is the rich judgment air-fuel ratio AFrich or less. When it is judged that the output air-fuel ratio AFdwn of the downstream side air-fuel ratio sensor 41 is greater than the rich judgment air-fuel ratio AFrich, the control routine is ended.

On the other hand, if the oxygen storage amount OSA of the upstream side exhaust purification catalyst 20 is reduced and the air-fuel ratio of the exhaust gas flowing out from the upstream side exhaust purification catalyst 20 falls, at the next control routine, it is judged at step S14 that the output air-fuel ratio AFdwn of the downstream side air-fuel ratio sensor 41 is the rich judgment air-fuel ratio AFrich or less. In this case, the routine proceeds to step S15 where the target air-fuel ratio AFT is set to the lean set air-fuel ratio AFTl. Next, at step S16, the lean setting flag F1 is set to 1 and the control routine is ended.

At the next control routine, at step S13, it is judged that the lean setting flag F1 has been set to 0 and the routine proceeds to step S17. At step S17, it is judged if the cumulative oxygen excess/deficiency ΣOED which was calculated at step S12 is smaller than the judgment reference value OEDref. When it is judged that the cumulative oxygen excess/deficiency ΣOED is smaller than the judgment reference value OEDref, the routine proceeds to step S18. At step S18, it is judged if the output air-fuel ratio AFdwn of the downstream side air-fuel ratio sensor 41 is the lean judgment air-fuel ratio AFlean or more, that is, if the oxygen storage amount OSA has reached the vicinity of the maximum storable oxygen amount Cmax. When, at step S18, it is judged that the output air-fuel ratio AFdwn is smaller than the lean judgment air-fuel ratio AFlean, the routine proceeds to step S19. At step S19, the target air-fuel ratio AFT continues to be set to the lean set air-fuel ratio AFTl.

On the other hand, if the oxygen storage amount of the upstream side exhaust purification catalyst 20 increases, finally, at step S17, it is judged that the cumulative oxygen excess/deficiency ΣOED is the judgment reference value OEDref or more and the routine proceeds to step S20. Alternatively, when the oxygen storage amount OSA reaches the vicinity of the maximum storable oxygen amount Cmax, at step S18, it is judged that the output air-fuel ratio AFdwn of the downstream side air-fuel ratio sensor 41 is the lean judgment air-fuel ratio AFlean or more and the routine proceeds to step S20. At step S20, the target air-fuel ratio AFT is set to the rich set air-fuel ratio AFTr, then, at step S21, the lean setting flag F1 is reset to 0 and the control routine is ended.

Figure 11:
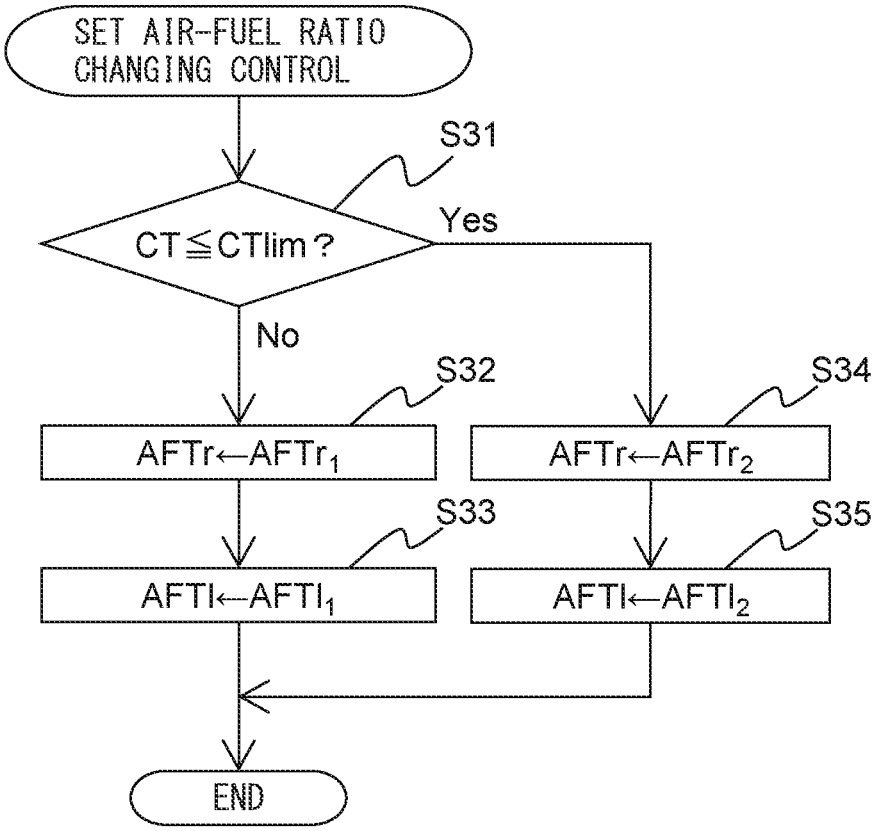
FIG. 11 is a flow chart which shows a control routine of control for changing set air-fuel ratios in a first embodiment.

FIG. 11 is a flow chart which shows a control routine in control for changing the set air-fuel ratios. The illustrated control routine is performed by interruption every certain time interval. First, at step S31, it is judged if the temperature CT of the upstream side exhaust purification catalyst 20 detected by the upstream side temperature sensor 46 is the sulfur storage upper limit temperature CTlim or less. When it is judged that the temperature CT is higher than the sulfur storage upper limit temperature CTlim, the routine proceeds to step S32. At step S32, the rich set air-fuel ratio AFTr is set to the first rich set air-fuel ratio $AFTr_1$. Next, at step S33, the lean set air-fuel ratio AFTl is set to the first lean set air-fuel ratio $AFTl_1$ and control routine is ended.

On the other hand, when, at step S31, it is judged that the temperature CT is the sulfur storage upper limit temperature CTlim or less, the routine proceeds to step S34. At step S34, the rich set air-fuel ratio AFTr is set to the second rich set air-fuel ratio $AFTr_2$. Next, at step S35, the lean set air-fuel ratio AFTl is set to the second lean set air-fuel ratio $AFTl_2$ and the control routine is ended.

Second Embodiment

Next, referring to FIG. 12 and FIG. 13, a control system according to a second embodiment of the present invention will be explained. The configuration and control in the control system of the second embodiment are basically similar to the configuration and control of the control system of the first embodiment. However, in the second embodiment, the values of the two set air-fuel ratios are changed based on the intake air amount of the internal combustion engine.

In general, the temperature of the upstream side exhaust purification catalyst 20 changes in accordance with the flow rate of high temperature exhaust gas flowing into the upstream side exhaust purification catalyst 20, that is, the amount of intake air fed to a combustion chamber 5 of an internal combustion engine. Therefore, the greater the amount of intake air fed to a combustion chamber 5 of an internal combustion engine, the more the temperature of the upstream side exhaust purification catalyst 20 also rises. For this reason, the temperature of the upstream side exhaust purification catalyst 20 can be estimated based on the amount of intake air fed to a combustion chamber 5 of an internal combustion engine. Specifically, when the amount of intake air fed to a combustion chamber 5 of an internal combustion engine is the upper limit intake air amount or less, it can be estimated that the temperature of the upstream side exhaust purification catalyst 20 is the sulfur storage upper limit temperature or less. Conversely, when the amount of intake air fed to a combustion chamber 5 of an internal combustion engine is greater than the upper limit intake air amount, it can be estimated that the temperature of the upstream side exhaust purification catalyst 20 is higher than the sulfur storage upper limit temperature.

Therefore, in the present embodiment, the difference of the lean set air-fuel ratio from the stoichiometric air-fuel ratio (lean degree) and the difference of the rich set air-fuel ratio from the stoichiometric air-fuel ratio (rich degree) are changed in accordance with the intake air amount calculated based on the output of the air flowmeter 39 etc.

Figure 12:
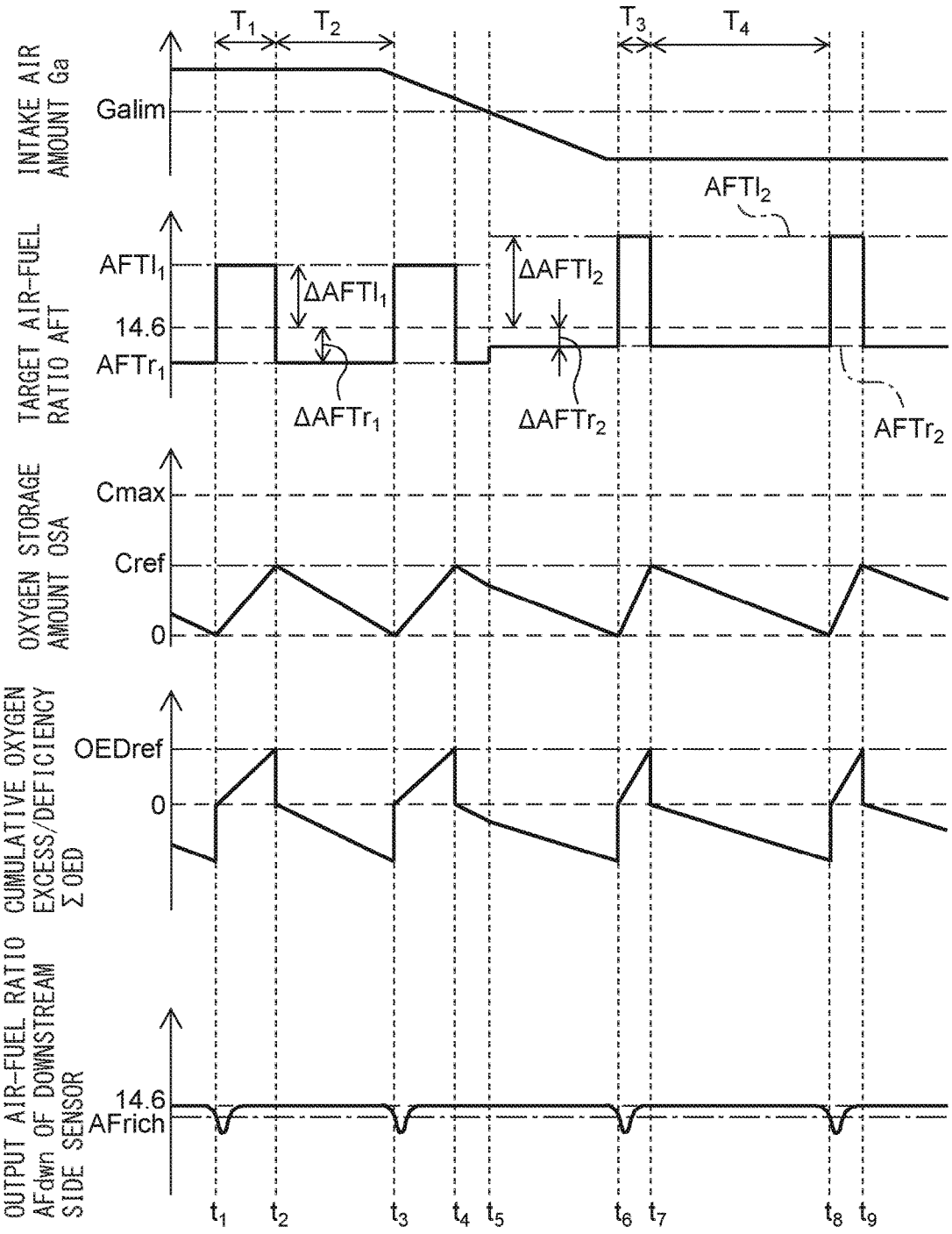
FIG. 12 is a time chart of a target air-fuel ratio etc. similar to FIG. 6.

FIG. 12 is a time chart, similar to FIG. 6, of a target air-fuel ratio AFT etc. when performing control to change the rich set air-fuel ratio and the lean set air-fuel ratio in the present embodiment. In the example shown in FIG. 12, before the time $t_5$, the intake air amount Ga fed to the combustion chamber 5 of the internal combustion engine is greater than the upper limit intake air amount Galim. At this time, the rich set air-fuel ratio AFTr and the lean set air-fuel ratio AFTl are respectively set to the first rich set air-fuel ratio $AFTr_1$ and the first lean set air-fuel ratio $AFTl_1$.

On the other hand, at the time $t_5$, if the intake air amount Ga fed to the combustion chamber 5 of the internal combustion engine becomes the upper limit intake air amount Galim or less, the rich set air-fuel ratio AFTr is changed from the first rich set air-fuel ratio $AFTr_1$ to the second rich set air-fuel ratio $AFTr_2$. In addition, the lean set air-fuel ratio AFTl is changed from the first lean set air-fuel ratio $AFTl_1$ to the second lean set air-fuel ratio $AFTl_2$. Note that, the relationship of the first rich set air-fuel ratio $AFTr_1$, the first lean set air-fuel ratio $AFTl_1$, the second rich set air-fuel ratio $AFTr_2$, and the second lean set air-fuel ratio $AFTl_2$ in the present embodiment are similar to the relationship in the first embodiment.

In the present embodiment, the both of the set air-fuel ratios are changed when the intake air amount Ga supplied to a combustion chamber 5 of an internal combustion engine becomes the upper limit intake air amount Galim. As a result, in substance, it can be said that the both of the set air-fuel ratios are changed when the temperature CT of the upstream side exhaust purification catalyst 20 becomes the sulfur storage upper limit temperature CTlim. Therefore, in the present embodiment as well, in the same way as the first embodiment, it is possible to suppress the storage of the sulfur ingredients in the upstream side exhaust purification catalyst 20 and accordingly it is possible to keep low the sulfur ingredient storage amount of the upstream side exhaust purification catalyst 20.

Further, depending on the operating state of the internal combustion engine, for example, the intake air amount Ga supplied to a combustion chamber 5 of an internal combustion engine sometimes rapidly rises. In this case, if the lean degree of the lean set air-fuel ratio AFTl is high, oxygen and $NO_X$ will rapidly flow into the upstream side exhaust purification catalyst 20. Therefore, in some cases, the oxygen storage amount OSA of the upstream side exhaust purification catalyst 20 reaches the maximum storable oxygen amount Cmax, and there is the possibility of $NO_X$ flowing out from the upstream side exhaust purification catalyst 20. However, in the present embodiment, when the intake air amount Ga supplied to a combustion chamber 5 of an internal combustion engine is large, the lean degree of the lean set air-fuel ratio AFTl is lowered. For this reason, even in such a case, $NO_X$ is kept from flowing out from the upstream side exhaust purification catalyst 20.

Note that, in the present embodiment as well, in the same way as the example shown in FIG. 8 and FIG. 9, it is also possible to change only the lean set air-fuel ratio AFTl or only the rich set air-fuel ratio AFTr. In addition, in the present embodiment as well, the lean set air-fuel ratio AFTl and the rich set air-fuel ratio AFTr may be set so as to fluctuate by a certain degree. Further, the intake air amount for changing the set air-fuel ratios does not necessarily have to be the upper limit intake air amount and may also be a smaller intake air amount.

Figure 13:
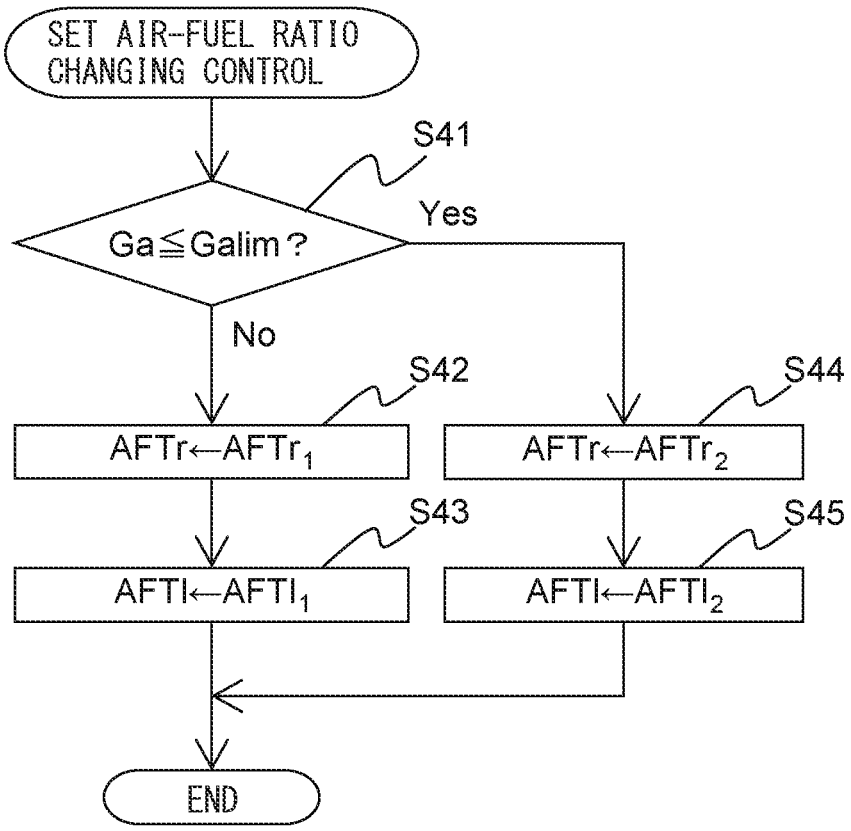
FIG. 13 is a flow chart which shows a control routine of control for changing set air-fuel ratios in a second embodiment.

FIG. 13 is a flow chart which shows a control routine of control for changing the set air-fuel ratios in the present embodiment. The illustrated control routine is performed by interruption every certain time interval. Note that, steps S42 to S45 of FIG. 13 are similar to steps S32 to S35 of FIG. 11, and therefore an explanation will be omitted.

In the control routine shown in FIG. 13, at step S41, it is judged that the intake air amount Ga calculated based on the output of the air flowmeter 39 etc. is the upper limit intake air amount Galim or less. When it is judged that the intake air amount Ga is larger than the upper limit intake air amount Galim, the routine proceeds to steps S42 and S43 where the rich set air-fuel ratio AFTr and the lean set air-fuel ratio AFTl are respectively set to the first rich set air-fuel ratio $AFTr_1$ and the first lean set air-fuel ratio $AFTl_1$. On the other hand, when it is judged that the intake air amount Ga is the upper limit intake air amount Galim or less, the routine proceeds to steps S44 and S45 where the rich set air-fuel ratio AFTr and the lean set air-fuel ratio AFTl are respectively set to the second rich set air-fuel ratio $AFTr_2$ and the second lean set air-fuel ratio $AFTl_2$.

Third Embodiment

Next, referring to FIG. 14 and FIG. 15, a control system according to a third embodiment of the present invention will be explained. The configuration and control in the control system of the third embodiment are basically similar to the configuration and control of the control systems of the first embodiment and the second embodiment. However, in the third embodiment, the values of both of the set air-fuel ratios are changed depending on whether the internal combustion engine is engaged in idling operation.

In this regard, when the internal combustion engine is engaged in idling operation, compared with when it is engaged in other operations, the exhaust gas discharged from a combustion chamber 5 is low in temperature. As a result, the upstream side exhaust purification catalyst 20 also becomes low in temperature. Therefore, when the internal combustion engine is engaged in idling operation, the temperature CT of the upstream side exhaust purification catalyst 20 can be said to be a given temperature not higher than the sulfur storage upper limit temperature CTlim. Therefore, in the present embodiment, depending on whether the internal combustion engine is engaging in idling operation, the difference of the lean set air-fuel ratio from the stoichiometric air-fuel ratio (lean degree) and the difference of the rich set air-fuel ratio from the stoichiometric air-fuel ratio (rich degree) are changed.

Figure 14:
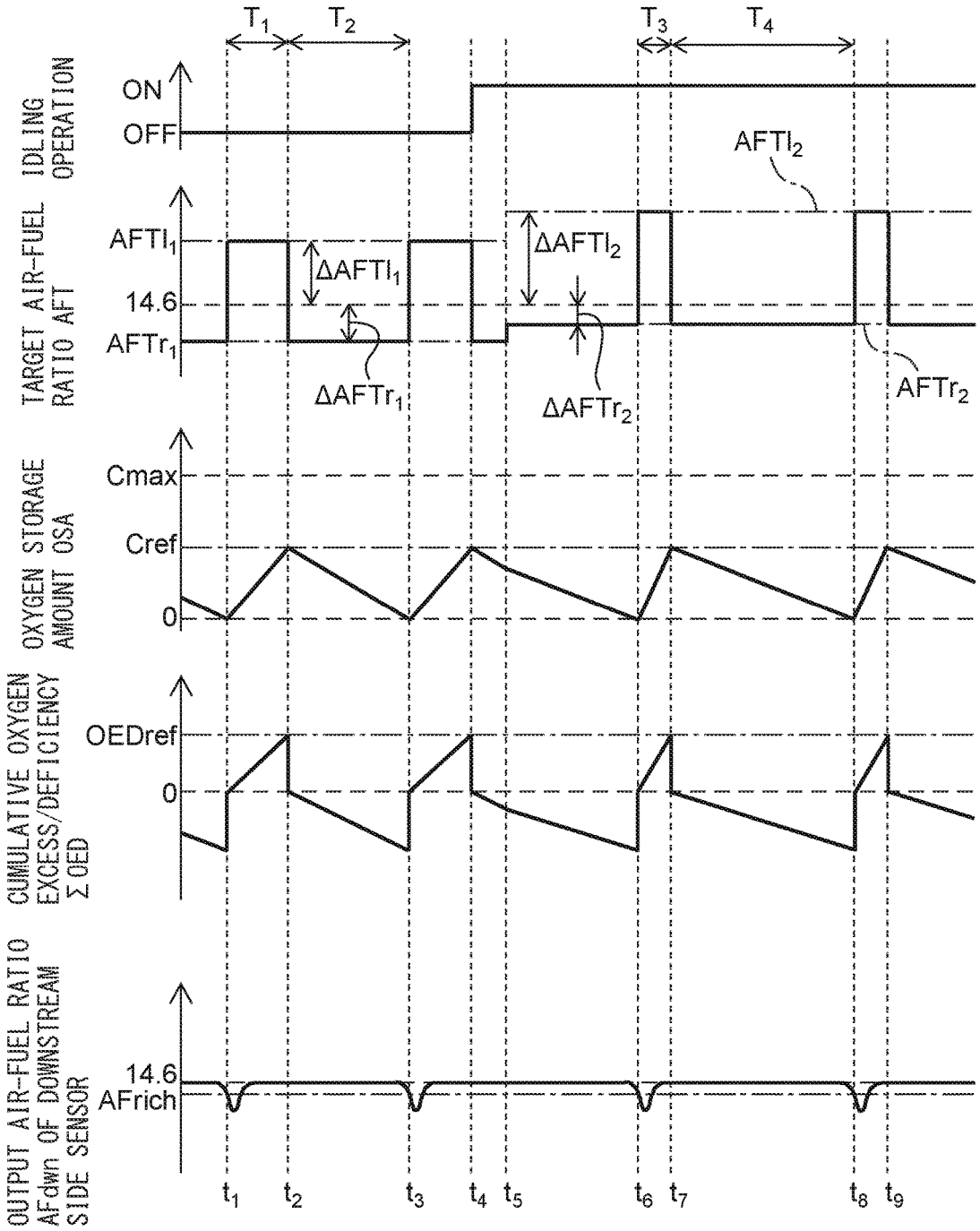
FIG. 14 is a time chart of a target air-fuel ratio etc. similar to FIG. 6.

FIG. 14 is a time chart similar to FIG. 6 of a target air-fuel ratio AFT etc. when performing control to change the rich set air-fuel ratio and the lean set air-fuel ratio in the present embodiment. In the example shown in FIG. 14, before the time $t_5$, the internal combustion engine is not engaged in idling operation. At this time, the rich set air-fuel ratio AFTr and the lean set air-fuel ratio AFTl are respectively set to the first rich set air-fuel ratio $AFTr_1$ and the first lean set air-fuel ratio $AFTl_1$.

On the other hand, at the time $t_5$, if the internal combustion engine starts idling operation, the rich set air-fuel ratio AFTr is changed from the first rich set air-fuel ratio $AFTr_1$ to the second rich set air-fuel ratio $AFTr_2$. In addition, the lean set air-fuel ratio AFTl is changed from the first lean set air-fuel ratio $AFTl_1$ to the second lean set air-fuel ratio $AFTl_2$. Note that, in the present embodiment, the relationship of the first rich set air-fuel ratio $AFTr_1$, the first lean set air-fuel ratio $AFTl_1$, the second rich set air-fuel ratio $AFTr_2$, and the second lean set air-fuel ratio $AFTl_2$ is similar to the relationship in the first embodiment.

In the present embodiment, both of the set air-fuel ratios are changed depending on whether the internal combustion engine is engaged in idling operation. As a result, in substance, it can be said that both of the set air-fuel ratios are changed when the temperature CT of the upstream side exhaust purification catalyst 20 becomes a constant temperature lower than the sulfur storage upper limit temperature CTlim. Therefore, in the present embodiment as well, in the same way as the first embodiment, it is possible to suppress the storage of the sulfur ingredients in the upstream side exhaust purification catalyst 20 and accordingly it is possible to keep low the sulfur ingredient storage amount of the upstream side exhaust purification catalyst 20.

Further, when the internal combustion engine is engaged in idling operation, the amount of intake air fed to a combustion chamber 5 of an internal combustion engine is extremely small. For this reason, even if the intake air amount etc. becomes disturbed, large amounts of oxygen and $NO_X$ almost never flow into the upstream side exhaust purification catalyst 20. For this reason, disturbance occurring in the intake air amount etc. causing $NO_X$ to temporarily flow out from the upstream side exhaust purification catalyst 20 is suppressed. Note that, in the present embodiment as well, in the same way as the example shown in FIG. 8 and FIG. 9, it is also possible to change only the lean set air-fuel ratio AFTl or only the rich set air-fuel ratio AFTr.

Figure 15:
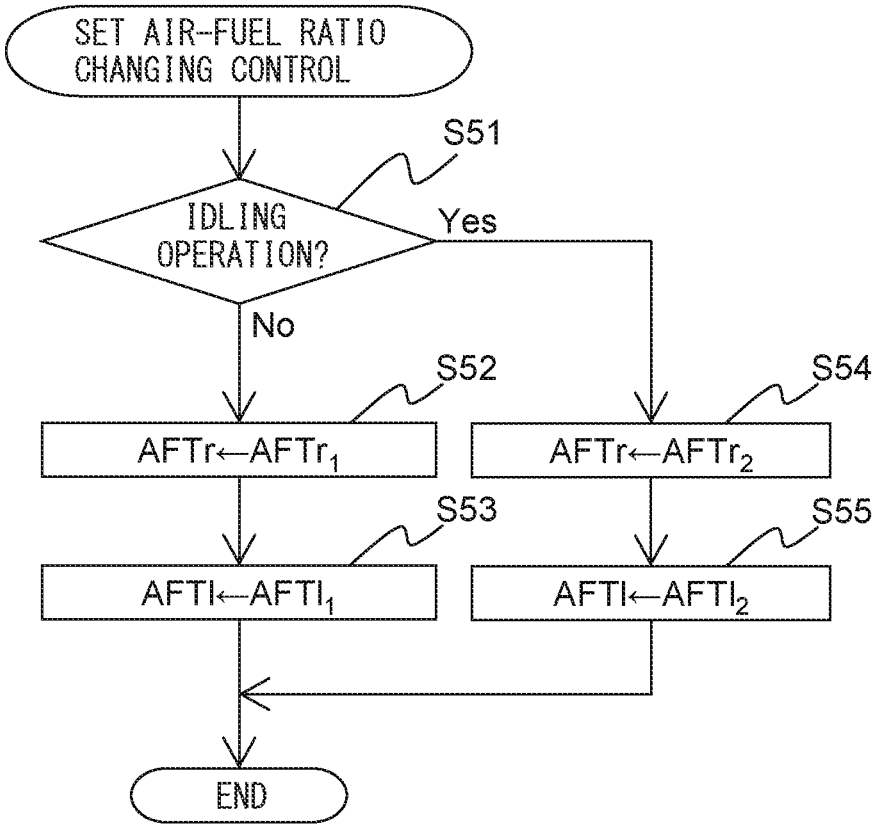
FIG. 15 is a flow chart which shows a control routine of control for changing set air-fuel ratios in a third embodiment.

FIG. 15 is a flow chart which shows a control routine of control for changing the set air-fuel ratios in the present embodiment. The illustrated control routine is performed by interruption every certain time interval. Note that, steps S52 to S55 of FIG. 15 are similar to steps S32 to S35 of FIG. 11, and therefore an explanation will be omitted.

In the control routine shown in FIG. 15, at step S51, it is judged if the internal combustion engine is in an idling operation. Whether the internal combustion engine is in an idling operation is, for example, judged based on the engine load detected by the load sensor 43 and the engine speed detected by the crank angle sensor 44. In this case, for example, when the engine load is the predetermined idling judgment load or less and the engine speed is the predetermined idling judgment speed or less, it is judged that the engine is in an idling operation.

When it is judged at step S51 that the internal combustion engine is not in an idling operation, the routine proceeds to steps S52 and S53 where the rich set air-fuel ratio AFTr and the lean set air-fuel ratio AFTl are respectively set to the first rich set air-fuel ratio $AFTr_1$ and the first lean set air-fuel ratio $AFTl_1$. On the other hand, when it is judged at step S51 that the internal combustion engine is in an idling operation, the routine proceeds to steps S54 and S55 where the rich set air-fuel ratio AFTr and lean set air-fuel ratio AFT are respectively set to the second rich set air-fuel ratio $AFTr_2$ and the second lean set air-fuel ratio $AFTl_2$.

In this regard, each of the first embodiment to the third embodiment is predicated on performing the control shown in FIG. 5 as the air-fuel ratio control. However, the predicated air-fuel ratio control does not necessarily have to be the control shown in FIG. 5. The control may be any control so long as alternately setting the target air-fuel ratio to the rich air-fuel ratio and the lean air-fuel ratio.

Figure 16:
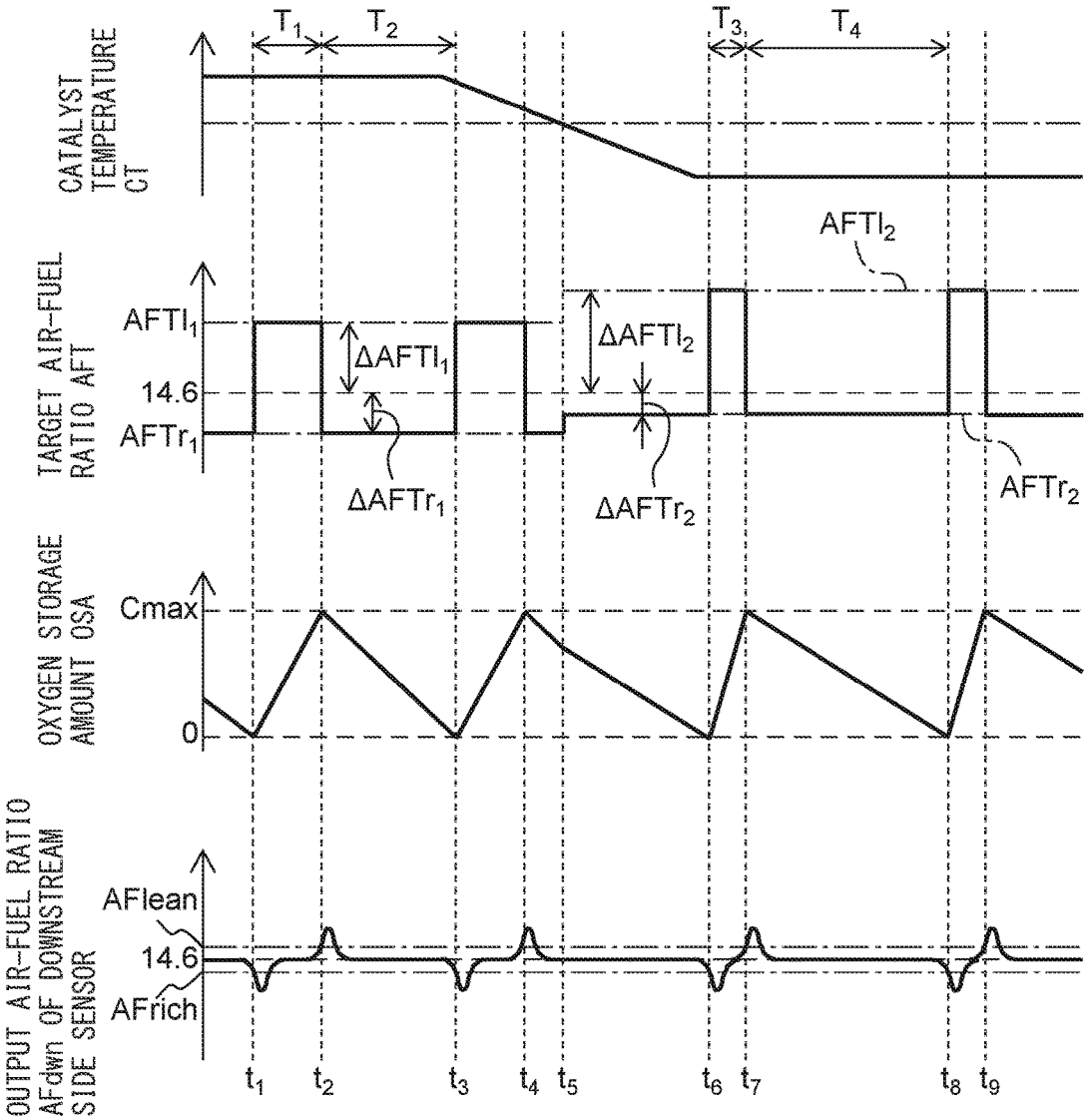
FIG. 16 is a time chart of a target air-fuel ratio etc. similar to FIG. 6.

As such control, for example, the control shown in FIG. 16 may be considered. In the control shown in FIG. 16 as well, a target air-fuel ratio setting control which sets the target air-fuel ratio based on the output air-fuel ratio of the downstream side air-fuel ratio sensor 41 is performed. In this target air-fuel ratio setting control, when the output air-fuel ratio AFdwn of the downstream side air-fuel ratio sensor 41 becomes the rich air-fuel ratio, specifically, when the output air-fuel ratio AFdwn becomes the rich judgment air-fuel ratio AFrich or less, the target air-fuel ratio AFT is set to the lean set air-fuel ratio AFTl (for example, the times $t_1$, $t_3$, $t_6$, $t_8$ in the figure). On the other hand, when the output air-fuel ratio AFdwn of the downstream side air-fuel ratio sensor 41 becomes the lean air-fuel ratio, specifically, when the output air-fuel ratio AFdwn becomes the lean judgment air-fuel ratio AFlean or more, the target air-fuel ratio AFT is set to the rich set air-fuel ratio AFTr (for example, the times $t_2$, $t_4$, $t_7$, $t_9$ in the figure).

Even if performing such air-fuel ratio control, control similar to the first embodiment to the third embodiment is performed. In the example shown in FIG. 16, before the time $t_5$, the temperature CT of the upstream side exhaust purification catalyst 20 becomes higher than the sulfur storage upper limit temperature CTlim. At this time, the rich set air-fuel ratio AFTr and the lean set air-fuel ratio AFTl are respectively set to the first rich set air-fuel ratio $AFTr_1$ and the first lean set air-fuel ratio $AFTl_1$.

On the other hand, when, at the time $t_5$, the temperature CT of the upstream side exhaust purification catalyst 20 becomes the sulfur storage upper limit temperature CTlim or less, the rich set air-fuel ratio AFTr is changed from the first rich set air-fuel ratio $AFTr_1$ to the second rich set air-fuel ratio $AFTr_2$. In addition, the lean set air-fuel ratio AFTl is changed from the first lean set air-fuel ratio $AFTl_1$ to the second lean set air-fuel ratio $AFTl_2$.

REFERENCE SIGNS LIST

1 engine body
5 combustion chamber
7 intake port
9 exhaust port
19 exhaust manifold
20 upstream side exhaust purification catalyst
24 downstream side exhaust purification catalyst
31 ECU
40 upstream side air-fuel ratio sensor
41 downstream side air-fuel ratio sensor

The invention claimed is:

1. A control system of an internal combustion engine, the internal combustion engine comprising an exhaust purification catalyst which is arranged in an exhaust passage of the internal combustion engine and which can store oxygen, and the internal combustion engine including a temperature sensor for detecting a temperature of the exhaust purification catalyst, the control system comprising:

an electronic control unit (ECU) including a processor for executing programs stored in memory, and an at least one input/output port in communication with the temperature sensor, the ECU configured to:

perform feedback control so that an air-fuel ratio of exhaust gas flowing into said exhaust purification catalyst becomes a target air-fuel ratio, and perform target air-fuel ratio setting control which alternately sets said target air-fuel ratio to a rich set air-fuel ratio richer than a stoichiometric air-fuel ratio and a lean set air-fuel ratio leaner than the stoichiometric air-fuel ratio, wherein when the temperature of said exhaust purification catalyst which has been detected by said temperature sensor is less than or equal to a predetermined upper limit temperature, the values of the rich set air-fuel ratio and the lean set air-fuel ratio are changed so that a variation difference is increased as compared to when the temperature of said exhaust purification catalyst is higher than said upper limit temperature, said variation difference having a value equal to a rich degree, which is a difference of said rich set air-fuel ratio and stoichiometric air-fuel ratio, subtracted from a lean degree, which is a difference of said lean set air-fuel ratio and stoichiometric air-fuel ratio.

2. The control system of an internal combustion engine according to claim 1, wherein when the temperature of said exhaust purification catalyst which has been detected by said temperature sensor is said predetermined upper limit temperature or less, compared to when it is higher than said upper limit temperature, a lean degree of said lean set air-fuel ratio is set larger.

3. The control system of an internal combustion engine according to claim 1, wherein a rich degree when the catalyst temperature is the upper limit temperature or less is set smaller than that when the catalyst temperature is higher than the upper limit temperature.

4. The control system of an internal combustion engine according to claim 1, further comprising a downstream side air-fuel ratio sensor which is arranged at a downstream side of a direction of flow of exhaust of said exhaust purification catalyst and which detects an air-fuel ratio of the exhaust gas flowing out from said exhaust purification catalyst, wherein in said target air-fuel ratio setting control, when the air-fuel ratio detected by said downstream side air-fuel ratio sensor becomes not higher than a rich judgment air-fuel ratio richer than the stoichiometric air-fuel ratio or less, said target air-fuel ratio is switched to the lean set air-fuel ratio, and when an oxygen storage amount of said exhaust purification catalyst becomes not smaller than a predetermined the switching reference storage amount which is smaller than the maximum storable oxygen amount, said target air-fuel ratio is switched to the rich set air-fuel ratio.

5. The control system of an internal combustion engine according to claim 1, further comprising a downstream side air-fuel ratio sensor which is arranged at a downstream side of a direction of flow of exhaust of said exhaust purification catalyst and which detects an air-fuel ratio of the exhaust gas flowing out from said exhaust purification catalyst, wherein in said target air-fuel ratio setting control, when the air-fuel ratio detected by said downstream side air-fuel ratio sensor becomes not higher than a rich judgment air-fuel ratio richer than the stoichiometric air-fuel ratio, said target air-fuel ratio is switched to the lean set air-fuel ratio, and when the air-fuel ratio detected by said downstream side air-fuel ratio sensor becomes not lower than a lean judgment air-fuel ratio leaner than the stoichiometric air-fuel ratio, said target air-fuel ratio is switched to the rich set air-fuel ratio.

6. A control system of an internal combustion engine, the internal combustion engine comprising an exhaust purification catalyst which is arranged in an exhaust passage of the internal combustion engine and which can store oxygen, the control system comprising:

an electronic control unit (ECU) including a processor for executing programs stored in memory, and an at least one input/output port in communication with the temperature sensor, the ECU configured to:

estimate a temperature of said exhaust purification catalyst, perform feedback control so that an air-fuel ratio of exhaust gas flowing into said exhaust purification catalyst becomes a target air-fuel ratio, and perform target air-fuel ratio setting control which alternately sets said target air-fuel ratio to a rich set air-fuel ratio richer than a stoichiometric air-fuel ratio and a lean set air-fuel ratio leaner than the stoichiometric air-fuel ratio, wherein when the temperature of said exhaust purification catalyst which has been estimated by the ECU is less than or equal to a predetermined upper limit temperature, the values of the rich set air-fuel ratio and the lean set air-fuel ratio are changed so that a variation difference is increased as compared to when the temperature of said exhaust purification catalyst is higher than said upper limit temperature, said variation difference having a value equal to a rich degree, which is a difference of said rich set air-fuel ratio and stoichiometric air-fuel ratio, subtracted from a lean degree, which is a difference of said lean set air-fuel ratio and stoichiometric air-fuel ratio.

7. The control system of an internal combustion engine according to claim 6, wherein when the temperature of said exhaust purification catalyst which has been estimated by the ECU is said predetermined upper limit temperature or less, compared to when it is higher than said upper limit temperature, a lean degree of said lean set air-fuel ratio is set larger.

8. The control system of an internal combustion engine according to claim 6, wherein a rich degree when the catalyst temperature is the upper limit temperature or less is set smaller than that when the catalyst temperature is higher than the upper limit temperature.

9. The control system of an internal combustion engine according to claim 6, wherein the ECU further configured to estimate an intake air amount of the internal combustion engine and, when an intake air amount estimated by the ECU is a predetermined upper limit intake air amount or less, it is estimated that the temperature of said exhaust purification catalyst is said upper limit temperature or less.

10. The control system of an internal combustion engine according to claim 6, wherein the ECU estimates that the temperature of said exhaust purification catalyst is said upper limit temperature or less when said internal combustion engine is engaged in idling operation.

11. The control system of an internal combustion engine according to claim 6, further comprising a downstream side air-fuel ratio sensor which is arranged at a downstream side of a direction of flow of exhaust of said exhaust purification catalyst and which detects an air-fuel ratio of the exhaust gas flowing out from said exhaust purification catalyst, wherein in said target air-fuel ratio setting control, when the air-fuel ratio detected by said downstream side air-fuel ratio sensor becomes not higher than a rich judgment air-fuel ratio richer than the stoichiometric air-fuel ratio or less, said target air-fuel ratio is switched to the lean set air-fuel ratio, and when an oxygen storage amount of said exhaust purification catalyst becomes not smaller than a predetermined the switching reference storage amount which is smaller than the maximum storable oxygen amount, said target air-fuel ratio is switched to the rich set air-fuel ratio.

12. The control system of an internal combustion engine according to claim 6, further comprising a downstream side air-fuel ratio sensor which is arranged at a downstream side of a direction of flow of exhaust of said exhaust purification catalyst and which detects an air-fuel ratio of the exhaust gas flowing out from said exhaust purification catalyst, wherein in said target air-fuel ratio setting control, when the air-fuel ratio detected by said downstream side air-fuel ratio sensor becomes not higher than a rich judgment air-fuel ratio richer than the stoichiometric air-fuel ratio, said target air-fuel ratio is switched to the lean set air-fuel ratio, and when the air-fuel ratio detected by said downstream side air-fuel ratio sensor becomes not lower than a lean judgment air-fuel ratio leaner than the stoichiometric air-fuel ratio, said target air-fuel ratio is switched to the rich set air-fuel ratio.

* * * * *